US006779499B2

(12) United States Patent
Takenaka et al.

(10) Patent No.: US 6,779,499 B2
(45) Date of Patent: Aug. 24, 2004

(54) VARIABLE VALVE TIMING APPARATUS

(75) Inventors: Akihiko Takenaka, Anjo (JP); Shigeyuki Kusano, Kariya (JP); Hirohiko Yamada, Okazaki (JP)

(73) Assignee: Denso Corporation, Kariya (JP)

( * ) Notice: Subject to any disclaimer, the term of this patent is extended or adjusted under 35 U.S.C. 154(b) by 22 days.

(21) Appl. No.: 10/107,148

(22) Filed: Mar. 28, 2002

(65) Prior Publication Data

US 2002/0139332 A1 Oct. 3, 2002

(30) Foreign Application Priority Data

Mar. 28, 2001 (JP) ..... 2001-092350
Mar. 30, 2001 (JP) ..... 2001-098078
Sep. 19, 2001 (JP) ..... 2001-285280
Jan. 22, 2002 (JP) ..... 2002-013119

(51) Int. Cl.[7] ..... F01L 1/34
(52) U.S. Cl. ..... 123/90.17; 123/90.15; 123/90.18
(58) Field of Search ..... 123/90.15, 90.16, 123/90.17, 90.18, 339.24, 90.12

(56) References Cited

U.S. PATENT DOCUMENTS 5,924,395 A * 7/1999 Moriya et al. ..... 123/90.15
6,035,816 A * 3/2000 Ogawa et al. ..... 123/90.17
6,053,139 A * 4/2000 Eguchi et al. ..... 123/90.17
6,055,948 A * 5/2000 Shiraishi et al. ..... 123/90.15
6,338,323 B1 * 1/2002 Machida ..... 123/90.17
6,386,164 B1 * 5/2002 Mikame et al. ..... 123/90.17
6,450,137 B2 * 9/2002 Ogawa ..... 123/90.17

FOREIGN PATENT DOCUMENTS

JP 9-324613 12/1997

OTHER PUBLICATIONS

U.S. application of Kusano et al, Ser. No. 10/107,416, filed Mar. 28, 2002, Apparatus for Controlling Valve Timing of Engine.

* cited by examiner

*Primary Examiner*—Thomas Denion
*Assistant Examiner*—Jaimie Corrigan
(74) *Attorney, Agent, or Firm*—Nixon & Vanderhye P.C.

(57) ABSTRACT

A variable valve timing apparatus rotatably receives a rotor in a housing. The rotor can rotate within a predetermined angular range. In some cases, the rotor is locked by a lock pin at an intermediate position within the angular range. In this manner, it is possible to realize a suitable valve timing even when an engine is restarted after it is stopped. In some case, the rotor is prevented from moving to the largest delay angle position by a restricting pin. In this manner, it is possible to prevent the rotor from reaching the largest delay angle position before the engine is stopped. On the other hand, while the engine is operated, it is possible to rotate the rotor to the largest delay angle position and to realize a valve timing responsive to the state of operation.

31 Claims, 24 Drawing Sheets

VARIABLE VALVE TIMING APPARATUS

CROSS REFERENCE TO RELATED APPLICATION

This application is based on Japanese Patent Applications No. 2001-92350 filed on Mar. 28, 2001, No. 2001-98078 filed on Mar. 30, 2001, No. 2001-285280 filed on Sep. 19, 2001, and No. 2002-13119 filed on Jan. 22, 2002 the contents of which are incorporated herein by reference.

BACKGROUND OF THE INVENTION

1. Field of the Invention

The present invention relates to a variable valve timing apparatus for varying an opening/closing timing of an intake valve or an exhaust valve of an internal combustion engine.

2. Description of Related Art

A variable timing mechanism is disclosed in JP-A No. 9-324613. This variable timing mechanism employs a lock pin capable of locking a rotor at a position (hereinafter referred to as intermediate phase position) where the rotor rotates a predetermined angle to an advance angle side from the largest delay angle position. When an engine starts, this lock pin is engaged with a lock depressed portion to lock the rotor at the intermediate phase position to thereby provide a given valve timing suitable for starting the engine. Further, after the engine starts, the lock pin is disengaged from the lock depressed portion to enable the rotor to rotate to a delay angle side further than the intermediate phase position, whereby the vale timing can be varied to both of the delay angle side and the advance angle side.

SUMMARY OF THE INVENTION

However, the lock pin disclosed in the abovementioned publication has a structure in which when the engine starts, hydraulic pressure is applied to the lock pin to disengage the lock pin from the lock depressed portion. Once the lock pin is disengaged from the lock depression, the lock pin does not act during a normal operation. For this reason, it is necessary to lock the lock pin at the intermediate phase position so that the rotor does not rotate to the largest delay angle position during an idling operation. However, when the number of revolution is low, in particular, when the temperature of the hydraulic oil is high, there is the case where the hydraulic pressure is decreased to make it impossible to secure the hydraulic pressure required to lock the rotor at the intermediate phase position.

Further, there is a problem that when an engine stall occurs, the rotor moves to and stops at the largest delay angle position to make it difficult to start the engine again.

The present invention has been made in view of the above circumstances, and it is the object of the present invention to provide a variable valve timing apparatus capable of securing a good startability of an internal combustion engine and expanding the variable range of a valve timing.

According to one aspect of the present invention, the variable valve timing apparatus has the first member for restricting a rotor's rotating to a part of operating range and the second member for locking the rotor at an intermediate position. As a result, the first member can prevent the rotor from reaching an undesirable range. On the other hand, the releasing of restriction of the rotation of the rotor by the first member can allow the rotor to rotate to the restricted range. For this reason, it is possible to realize a suitable valve timing as required. Further, since the second member fixes the rotor at the intermediate position, it can prevent the undesirable rotation of the rotor.

The intermediate position may be, for example, a position suitable for the starting of an engine. The range restricted by the first member may be a range on a delay angle side with respect to the intermediate position. As a result, it is possible to surely produce a valve timing suitable for the starting of the engine.

According to another aspect of the present invention, the variable valve timing apparatus has a rotor rotation restricting unit having a restricting pin for restricting the rotation of the rotor. This restricting pin moves according to a pressure difference between the first control chamber and the second control chamber. The restricting pin can restrict the rotation of the rotor and can prevent the rotor from reaching an undesirable range. On the other hand, the releasing of restriction of the rotation of the rotor can rotate the rotor within a wide range. As a result, it is possible to realize a suitable valve timing as required. Further, it is possible to control the restricting pin according to the pressure balance between the first control chamber and the second control chamber. For example, it is possible to lock the restricting pin at a restricting position.

According to still another aspect of the present invention, the variable valve timing apparatus has a lock pin for locking the rotor and a delay angle restricting pin for preventing the rotor from rotating from the intermediate position to a delay angle side. This delay angle restricting pin is urged by a spring to a restricting position and is moved by hydraulic pressure to a restriction releasing position. Therefore, the delay angle restricting pin is moved to the restricting position when the hydraulic pressure is decreased. Even when an engine speed is low and the hydraulic pressure is low, or even when an oil temperature is high and thus the hydraulic pressure becomes low, it is possible to surely keep the delay angle restricting pin at the restricting position.

According to still another aspect of the present invention, the variable valve timing apparatus has a restricting pin for restricting the rotational range of the rotor. The restricting pin is moved to the restricting position by a spring. The restricting pin is supplied with the hydraulic pressure by an exclusive oil passage provided independently of an oil passage for supplying the hydraulic pressure for rotating the rotor, thereby being moved to the restriction releasing position. The exclusive oil passage makes it possible to control the restricting pin without affecting the hydraulic pressure for rotating the rotor. For example, even when the engine speed is low and the hydraulic pressure is low, or even when the oil temperature is high and thus the hydraulic pressure becomes low, it is possible to surely keep the delay angle restricting pin at the restricting position.

According to still another aspect of the present invention, the variable valve timing apparatus has a pin which can move to three positions. The pin allows the rotor to freely rotate at the first position and restricts the rotational range of the rotor at the second position and locks the rotation of the rotor at the third position. Therefore, it is possible to selectively realize the restricting of rotation of the rotor and the locking of the rotor by only one pin.

BRIEF DESCRIPTION OF THE DRAWINGS

Features and advantages of embodiments will be appreciated, as well as methods of operation and the function of the related parts, from a study of the following detailed description, the appended claims, and the drawings, all of which form a part of this application. In the drawings:

DETAILED DESCRIPTION OF PREFERRED EMBODIMENTS

The preferred embodiments in accordance with the present invention will be described with reference to the accompanying drawings.

First Embodiment

Figure 1:
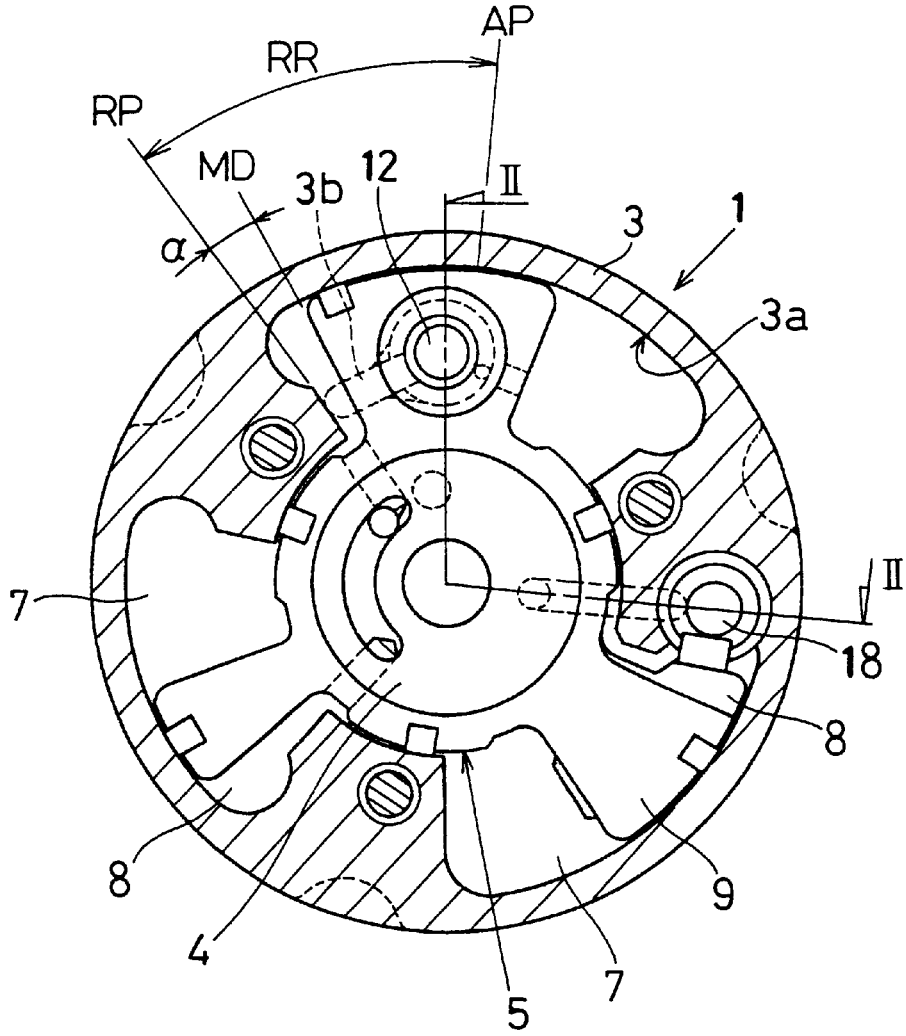
FIG. 1 is a cross sectional view of a variable valve timing apparatus (hereinafter referred to as VVT) in accordance with a first embodiment of the present invention.
Figure 2:
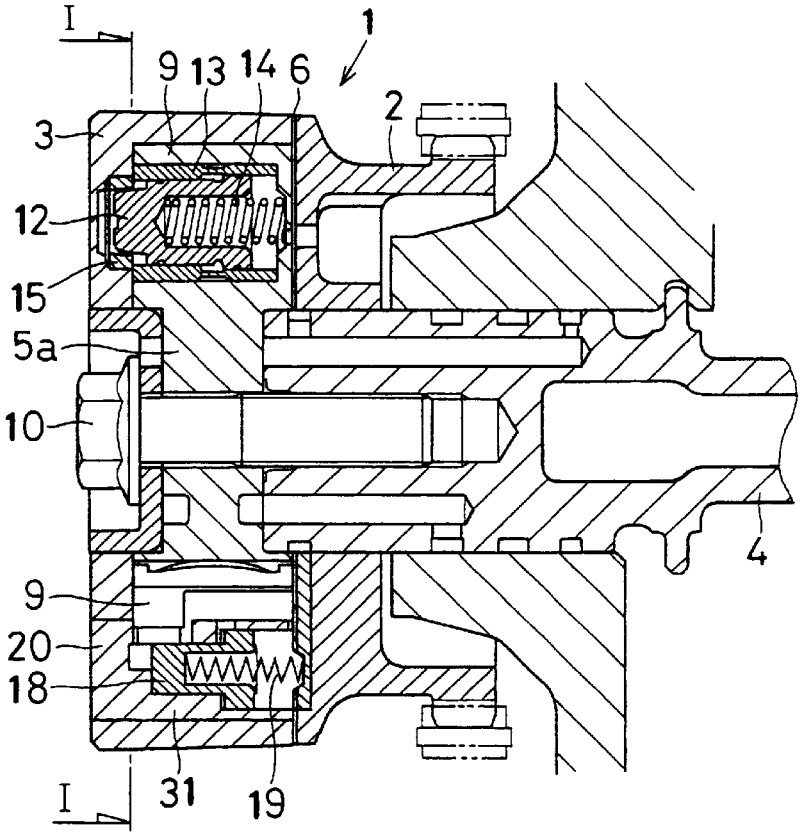
FIG. 2 is a cross sectional view taken on a line II—II of FIG. 1.

FIG. 1 is a cross sectional view of a variable valve timing apparatus (cross sectional view taken on a line I—I of FIG. 2) and FIG. 2 is a cross sectional view taken on a line II—II of FIG. 1.

The variable valve timing apparatus 1 (hereinafter referred to as VVT) has a sprocket 2 rotated by the rotational force transmitted by an engine, a case 3 rotated together with the sprocket 2, a rotor 5 secured to the camshaft 4 of the engine, and a rotor rotation preventing unit (which will be described later) for preventing the rotation of the rotor 5.

The sprocket 2 is rotatably fitted on the end portion of the camshaft 4 and has a rotational force transmitted thereto via a chain from the drive shaft (not shown) of the engine, thereby being rotated in synchronization with the drive shaft.

The case 3 is made of, for example, aluminum and is fixed to the sprocket 2 with a plate 6 (see FIG. 2) sandwiched between the sprocket 2 by bolts (not shown). This case 3, as shown in FIG. 1, has three depressions 3*a* formed in the circumferential direction each of which is shaped like a fan and forms hydraulic chambers (an advance angle chamber 7 and a delay angle chamber 8) between itself and the rotor 5.

The rotor 5 is constituted by three vanes 9 around a boss portion 5*a*, and the boss portion 5*a* abutting against the end surface of the camshaft 4, and the rotor 5 is fixed to the camshaft 4 by a bolt 10 screwed into the center of the boss portion 5*a*.

The vane 9 is received in the fan-shaped depression 3*a* formed in the case 3 and divides the hydraulic chamber into the advance angle chamber 7 and the delay angle chamber 8. A hydraulic oil is supplied to the advance angle chamber 7 and the delay angle chamber 8 via an oil control valve 11 which will be described later (see FIG. 3 to FIG. 5). In this manner, the rotation transmitted from the drive shaft of the engine to the sprocket 2 is transmitted to the vanes 9 via the hydraulic oil in the advance angle chamber 7 and the delay angle chamber 8 to thereby rotate the camshaft 4 in accordance with the rotor 5.

Figure 6:
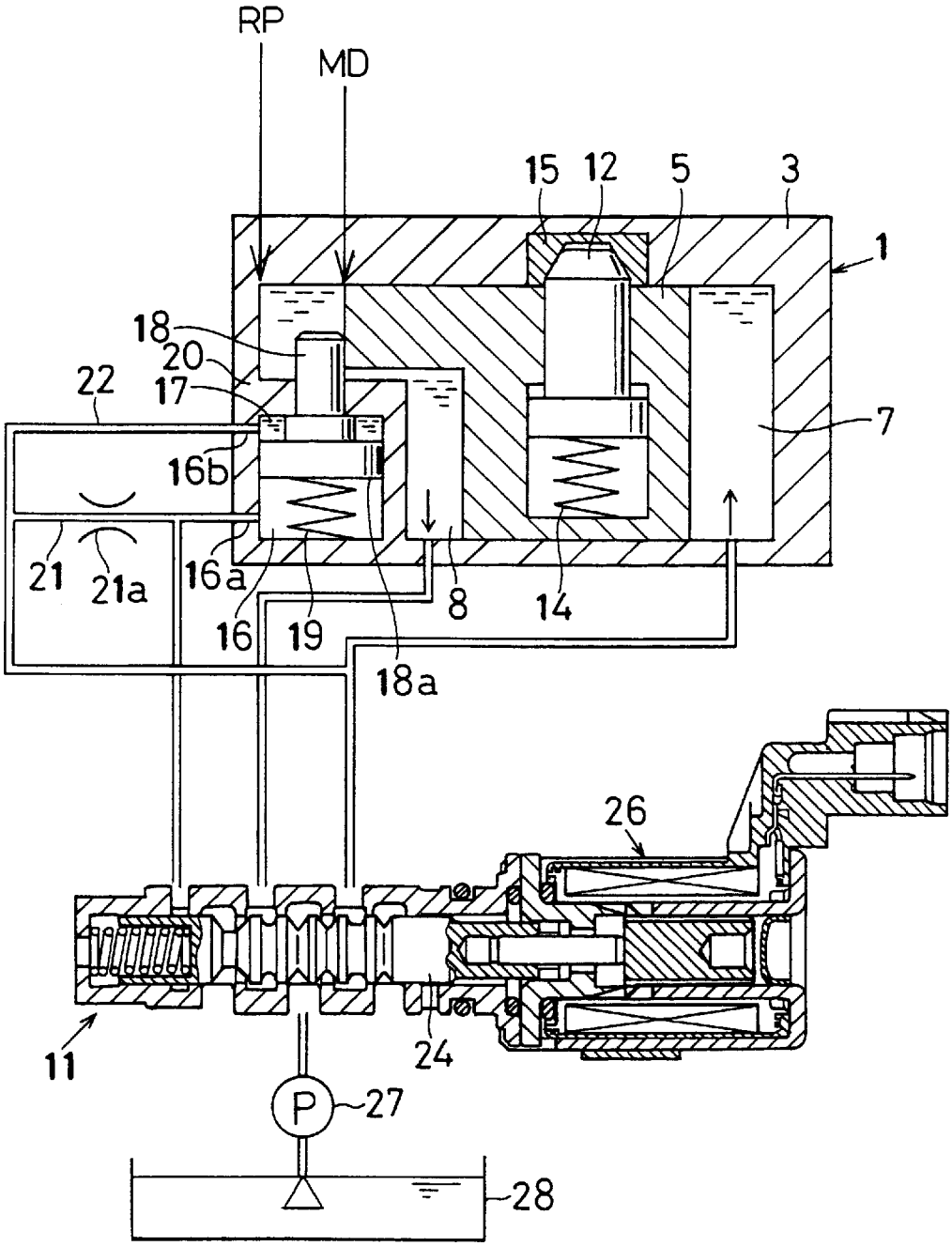
FIG. 6 is a configuration of a variable valve timing control system in accordance with the first embodiment of the present invention, which shows a state where an engine starts.

In one vane 9 is mounted a lock pin 12 (see FIG. 2) for preventing the rotor 5 from fluttering when the engine stops, just before the engine stops, or when the engine starts. This lock pin 12 is mounted in a sleeve 13, pressed into the vane 9, together with a spring 14. When the lock pin 12 is urged and pushed out by the spring 14, as shown in FIG. 6, the head portion of the lock pin 12 is fitted in a ring-shaped bush 15 provided in the case 3 to lock the rotor 5 at a "normal delay angle position MD". Incidentally, the "normal delay angle position MD" means the intermediate phase position MD where the rotor 5 rotates a predetermined angle alpha $\alpha$(see FIG. 1) toward the advance angle side from the largest delay angle position RP of the rotor 5.

Further, while the engine is operated, the hydraulic pressure of at least one of the delay angle chamber 7 and the advance angle chamber 8 is applied to the lock pin 12 in the direction that pushes down the lock pin 12 and overcomes the urging force of the spring 14 to separate the head portion of the lock pin 12 from the bush 15 to thereby allow the rotor 5 to rotate. Incidentally, the hydraulic pressure of the delay angle chamber 7 is introduced inside the sleeve 13 through a communication hole 9*a* (see FIG. 7) made in the vane 9 to act on a collar portion 12*a* made on the lock pin 12 to thereby push down the lock pin 12. Further, the hydraulic pressure in the advance angle chamber 8 acts on the head portion of the lock pin 12 through a communication groove 3*b* (see FIG. 1) made in the case 3 to push down the lock 12.

The rotor 5 can rotate over a predetermined angular range RR from the largest delay angle position RP to the largest advance angle position AP as shown in FIG. 1. The rotor rotation preventing unit prevents the rotor 5 from further rotating from a normal delay angle position MD toward a delaying direction. This unit is constituted by a control chamber (the first control chamber 16 and the second control chamber 17) into which the hydraulic pressure is introduced from the delay angle chamber 7, a delay angle restricting pin 18 moved by the hydraulic pressure of the control chamber, and a spring 19 for urging a delay angle restricting pin 18.

The control chamber, as shown schematically in FIG. 6, is formed of a sleeve 20 incorporated in the case 3 and is adjacent to the advance angle chamber 8. The sleeve 20 has the first hydraulic pressure introducing port 16*a* for introducing the hydraulic pressure into the bottom portion of the control chamber and the second hydraulic pressure introducing port 16*b* for introducing the hydraulic pressure into the top portion of the control chamber. The first hydraulic pressure introducing port 16*a* and the second hydraulic pressure introducing port 16*b* communicate with the delay angle chamber 7 through oil passages 21, 22, respectively. However, the oil passage 21 communicating with the first hydraulic pressure introducing port 16*a* is provided with an orifice 21*a*.

The delay angle restricting pin 18 has a collar-shaped pressure receiving portion 18*a* on its own rear end portion, and the pressure receiving portion 18*a* is received inside the sleeve 20 in such a way as to be in sliding contact with the inner peripheral surface of the sleeve 20 forming the control chamber, thereby partitioning the control chamber into the first control chamber 16 formed under the pressure receiving portion 18*a* and the second control chamber 17 formed above the pressure receiving portion 18*a*. However, in the pressure receiving portion 18*a*, a pressure receiving area exposed to the first control chamber 16 is made larger than a pressure receiving area exposed to the second control chamber 17.

The abovementioned first hydraulic pressure introducing port 16*a* is open to the first control chamber 16 and the second hydraulic pressure introducing port 16*b* is open to the second control chamber 17.

The delay angle restricting pin 18 is provided such that its head portion is liquid-tightly protruded from the control chamber into the advance angle chamber 8 and is retractably moved between a locking position (position shown in FIG. 6) for blocking the rotational path of the rotor 5 and a retracted position (position shown in FIG. 8) for allowing the rotation of the rotor 5.

The spring 19 is disposed in the first control chamber 16 to urge the delay angle restricting pin 18 from the retracted position side to the restricting position side.

Figure 4:
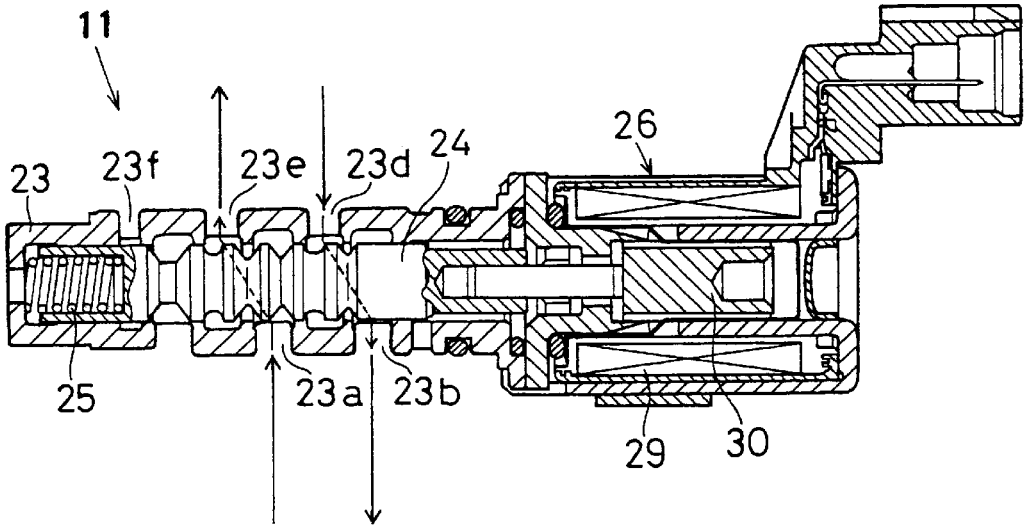
FIG. 4 is a cross sectional view of an oil control valve in accordance with the first embodiment of the present invention.
Figure 5:
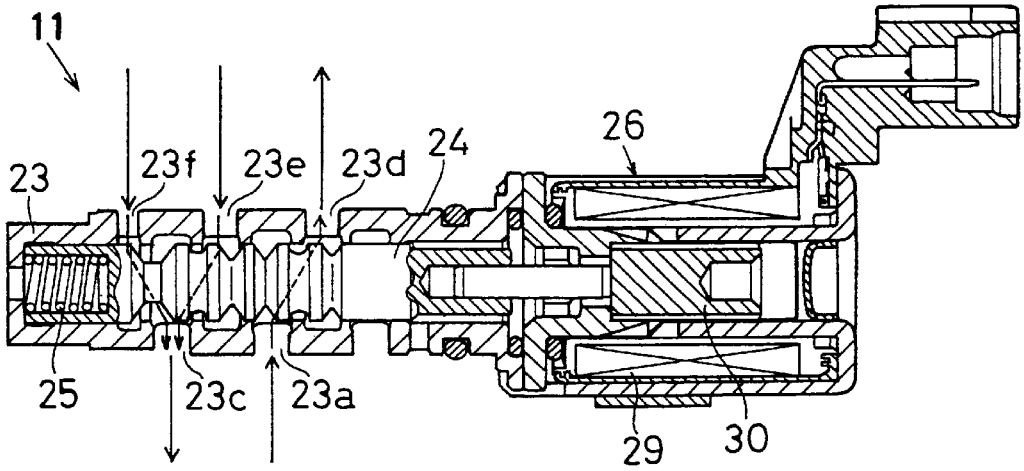
FIG. 5 is a cross sectional view of an oil control valve in accordance with the first embodiment of the present invention.

The oil control valve 11 switches the direction of flow (supply and discharge) of the hydraulic oil with respect to the delay angle chamber 7 and the advance angle chamber 8 and controls the amount of the hydraulic oil. The oil control valve 11, as shown in FIG. 3 to FIG. 5, is constituted by a casing 23 having a plurality of ports 23*a* to 23*f*, a spool 24 received in the casing 23 such that it can reciprocate therein, a spring 25 for urging the spool 24 in one direction (in the right direction in FIG. 3), and an electromagnetic actuator 26 for driving the spool 24 against the urging force of the spring 25.

Figure 3:
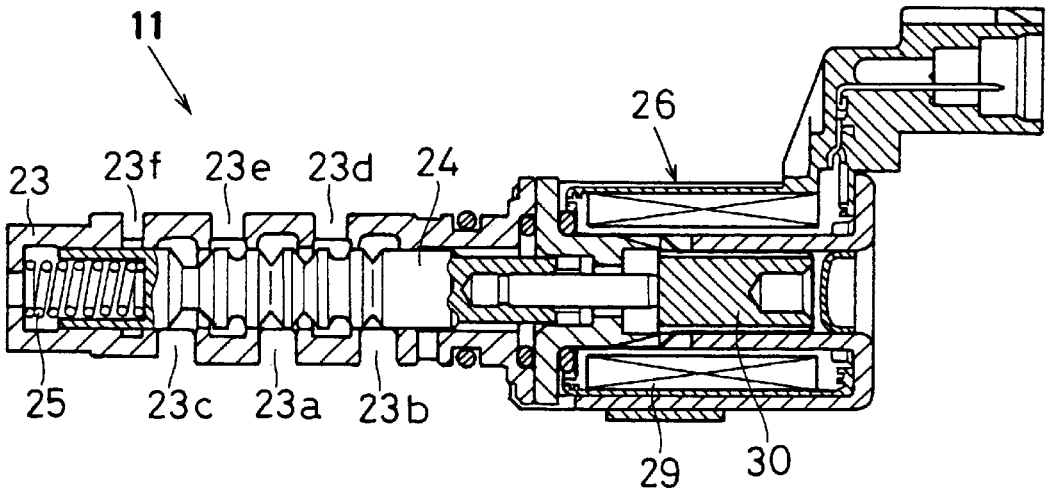
FIG. 3 is a cross sectional view of an oil control valve in accordance with the first embodiment of the present invention.

The casing 23, as shown in FIG. 3, has an inflow port 23*a* connected to the discharge port of a hydraulic pump 27 (see FIG. 6), two outflow ports (the first outflow port 23*b* and the second outflow port 23*c*) connected to an oil pan 28 (see FIG. 6) for storing the hydraulic oil, the first hydraulic port 23*d* connected to the delay angle chamber 7 of a VVT 1, the second hydraulic port 23*e* connected to the advance angle chamber 8 of the VVT 1, and the third hydraulic port 23*f* connected to the first control chamber 16 of the rotor rotation restricting unit through the abovementioned oil passage 21.

The spool 24 moves in the casing 23 and switches the respective hydraulic ports 23*d*, 23*e*, 23*f* which each communicate with the inflow port 23*a*, the outflow ports 23*b*, 23*c*.

The electromagnetic actuator 26 generates a magnetic force in a built-in coil 29 and moves a plunger 30 by the magnetic force to drive the spool 24. The amount of movement of the plunger 30 can be varied according to the magnitude of a current passing through the coil 29. The current passing through the coil 29 is duty-controlled by an ECU (electronically controlled unit, not shown).

Here, the relationship between the magnitude (duty ratio) of the current passing through the coil 29 and the position (operation mode) of the spool 24 will be described as follows.

a) Duty ratio=0% current passing through the coil 29=0.1 (A)

In this case, as shown in FIG. 3, the spool 24 moves to a position where it closes the third hydraulic port 23*f* and makes the inflow port 23*a* communicate with the first hydraulic port 23*d* and makes the second outflow port 23*c* communicate with the second hydraulic port 23*e*. This operation mode is called a normal delay angle mode.

b) Duty ratio=75% current passing through the coil 29=0.8 (A)

In this case, as shown in FIG. 4, the spool 24 moves to a position where it closes the third hydraulic port 23*f* and makes the inflow port 23*a* communicate with the second hydraulic port 23*e* and makes the first outflow port 23*b* communicate with the first hydraulic port 23*d*. This operation mode is called a normal advance angle mode.

c) Duty ratio=100% current passing through the coil 29=1.0 (A)

In this case, as shown in FIG. 5, the spool 24 moves to a position where it makes the inflow port 23*a* communicate with the first hydraulic port 23*d* and makes the second outflow port 23*c* communicate with the second hydraulic port 23*e* and the third hydraulic port 23*f*. This operation mode is called the largest delay angle mode. Incidentally, in the largest delay angle mode, a passage which is made in the casing 23 to make the second outflow port 23*c* communicate with the third hydraulic port 23*f* is called a drain passage.

Figure 7:
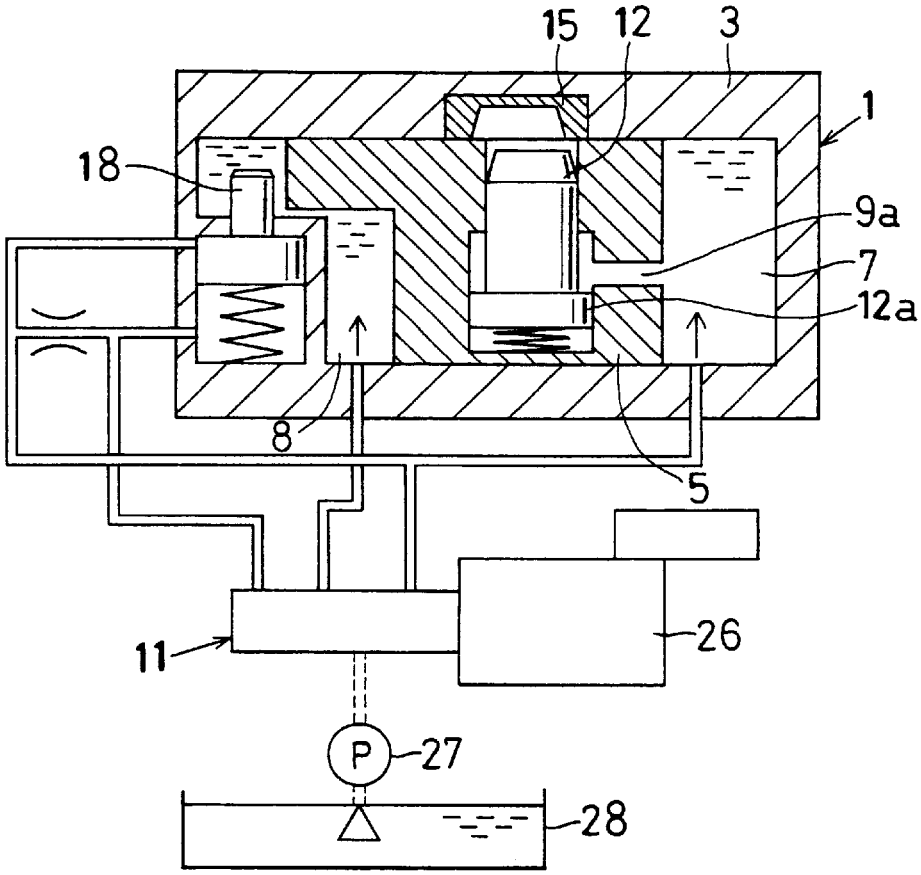
FIG. 7 is a configuration of a variable valve timing control system in accordance with the first embodiment of the present invention, which shows a state where an engine is operated under normal load.
Figure 8:
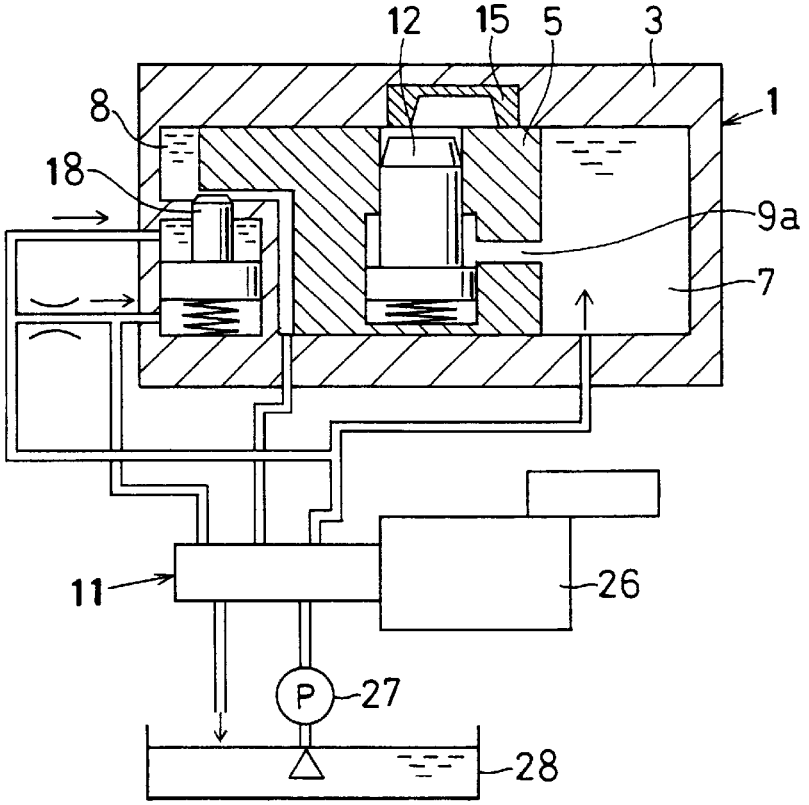
FIG. 8 is a configuration of a variable valve timing control system in accordance with the first embodiment of the present invention, which shows a state where an engine is operated under heavy load.

Next, the operation of the present embodiment will be described with reference to the schematic drawings shown in FIG. 6 to FIG. 8.

a) When the engine stops

The oil control valve 11 is locked in the normal delay angle mode (see FIG. 3). However, since the hydraulic pump 27 stops, the hydraulic oil is not supplied to the delay angle chamber 7.

In the rotor rotation restricting unit, the hydraulic pressure is not introduced into the first control chamber 16 and the second control chamber 17 from the delay angle chamber 7 and thus the delay angle restricting pin 18 is urged by the spring 19, whereby the head portion of the delay angle restricting pin 18 is protruded from the control chamber and is pushed out to a restricting position to block the rotational path pf the rotor 5 in the advance angle chamber 8. On the other hand, the rotor 5 does not receive the hydraulic pressure of the delay angle chamber 7 and the advance angle chamber 8 and the vane 9 abuts against the delay angle restricting pin 18 and stops at the normal delay angle position and is prevented from moving in the rotational direction by the lock pin 12 (see FIG. 6).

b) When the engine starts

The ECU sets the electromagnetic actuator 26 at a duty ratio=0% and controls the oil control valve 11 to the normal delay angle mode and starts the hydraulic pump 27.

Thereby, the hydraulic oil pressurized by the hydraulic pump 27 is supplied to the delay angle chamber 7 to increase the hydraulic pressure of the delay angle chamber 7. On the other hand, the hydraulic pressure of the advance angle chamber 8 is decreased because the second hydraulic port 23*e* and the second outflow port 23*c* of the oil control valve 11 are made to communicate with each other and are made open to the atmosphere (made to communicate with the oil pan 28).

In the rotor rotation restricting unit, the hydraulic pressure is introduced into the first control chamber 16 and the second control chamber 17 through the delay angle chamber 7. At this time, in the pressure receiving portion 18*a* of the delay angle restricting pin 18, the pressure receiving area exposed to the first control chamber 16 is larger than the pressure receiving area exposed to the second control chamber 17 and thus even if the same delay angle pressure (hydraulic pressure of the delay angle chamber 7) is introduced into the first control chamber 16 and the second control chamber 17, the force which is applied to the pressure receiving portion 18*a* to push out the delay angle restricting pin 18 is larger than the force which is applied to the pressure receiving portion 18*a* to push down the delay angle restricting pin 18. As a result, the delay angle restricting pin 18, as shown in FIG. 6, protrudes its head portion from the control chamber and keeps the state where it is pushed out to the restricting position.

In this manner, even if the hydraulic pressure is introduced into the delay angle chamber 7, the rotor 5 keeps the state where the delay angle restricting pin 18 is pushed out to the restricting position and thus does not rotate further to the delay angle side from the normal delay angle position but stops at the normal delay angle position. Incidentally, when the hydraulic pump 27 starts and introduces the hydraulic pressure into the sleeve 13 from the delay angle chamber 7, the hydraulic pressure applied to the lock pin 12 overcomes the urging force of the spring 14, so that the head of the lock pin 12 is separated from the bush 15 and is pushed into the sleeve 13 to allow the rotor to rotate.

c) When the engine operates under normal operation (including idling operation)

The ECU controls the current passing through the electromagnetic actuator 26 so that the duty ratio ranges from 0% to 75% according to the state of operation of the engine.

In this case, in the oil control valve 11, the spool 24 is set at a position between the normal delay angle mode and the normal advance angle mode according to the duty ratio and thus the inflow port 23*a* communicates with the first hydraulic port 23*d* and the second hydraulic port 23*e*.

As a result, as compared with the case where the engine starts, the amount of hydraulic oil supplied to the delay angle chamber 27 is decreased and the amount of hydraulic oil supplied to the advance angle chamber 28 is increased by the same amount. Thereby, as shown in FIG. 7, the rotor 5 rotates to a target advance angle position calculated by the ECU.

The rotor rotation restricting unit, as is the case when the engine starts, keeps the state where the delay angle restricting pin 18 is pushed out to the restricting position.

d) When the engine operates under heavy load operation (at high rotational speed under high hydraulic pressure)

The ECU sets the duty ratio of the electromagnetic actuator 26 at 100% to control the oil control valve 11 to the largest delay angle mode (see FIG. 5).

In this case, the oil control valve 11 moves from the operation mode at the normal operation (duty ratio=smaller than 75%) to the largest delay angle mode via the normal advance angle mode (duty ratio smaller than 75%).

In the rotor rotation restricting unit, the oil control valve 11 opens the drain passage (passage for making the third hydraulic port 23*f* communicate with the second outflow port 23*c*) and thus the hydraulic pressure in the first control chamber 16 is reduced to decrease the force for pushing out the delay angle restricting pin 18. On the other hand, since the hydraulic pressure in the second control chamber is kept, the force for pushing down the delay angle restricting pin 18 exceeds the force for pushing down the delay angle restricting pin 18, so that the delay angle restricting pin 18 is pushed down from the restricting position to the retracted position, as shown in FIG. 8.

In the VVT 1, the oil control valve 11 opens the second hydraulic port 23*e* communicating with the advance angle chamber 8 and supplies the hydraulic oil to the delay angle chamber 7, so that the hydraulic pressure of the delay angle chamber 7 is increased to rotate the rotor 5 further to the delay angle side beyond the normal delay angle position.

Advantages of the First Embodiment

In present embodiment, there is provided with the rotor rotation restricting unit capable of preventing the rotor 5 from rotating from the normal delay angle position to the delay angle side. That is, when the engine starts, the rotor 5 can be locked at the normal delay angle position by the rotor rotation restricting unit, so that it is possible to realize a valve timing suitable for starting the engine when the engine starts. Further, by pushing down the delay angle restricting pin 18 to the retracted position to release the rotor rotation restricting unit, the rotor 5 can be rotated to the largest delay angle position, so that it is possible to realize a valve timing suitable for improving fuel consumption and increasing power after the idling operation of the engine.

Further, by keeping a balance of pressure applied to the delay angle restricting pin 18 in the first control chamber 16 and in the second control chamber 17 in the state where the delay angle restricting pin 18 is pushed out to the restricting position, it is possible to lock the delay angle restricting pin 18 at the restricting position. As a result, for example, it is possible to prevent the rotor 5 from rotating further to the delay angle side beyond the normal delay angle position, for example, during the idling operation or the normal running operation. Further, by opening the first control chamber 16 to the atmosphere to release the hydraulic pressure, it is possible to push down the delay angle restricting pin 18 from the restricting position to the retracted position and thus to release the prevention of rotation of the rotor 5 to the largest delay angle position side.

That is, according to the rotor rotation restricting unit of the present embodiment, only when it is desired to rotate the rotor 5 to the largest delay angle position (for example, when it is desired to operate the engine under the heavy load), by pushing down the delay angle restricting pin 18 to the retracted position, it is possible to release the prevention of rotation of the rotor 5, and when the engine starts or the engine operates under normal load (including idling operation), it is possible to keep the state where the delay angle restricting pin 18 is pushed out to the restricting position, so that it is possible to prevent the rotor 5 from unnecessarily rotating to the largest delay angle position.

Further, since the oil passage 21 communicating with the first control chamber 16 from the delay angle chamber 7 is provided with the orifice 21*a*, when the first control chamber 16 is opened to the atmosphere to release the hydraulic pressure in the largest delay angle mode, it is possible to decrease the amount of hydraulic oil supplied to the first control chamber 16 through the oil passage 21 from the delay angle chamber 7. In other words, since the amount of hydraulic oil flowing out of the first control chamber 16 is larger than the amount of hydraulic oil flowing into the first control chamber 16 from the delay angle chamber 7, it is possible to quickly reduce the hydraulic pressure in the first control chamber 16.

As a result, it is possible to realize the most suitable valve timing for starting the engine and the most suitable valve timing for improving fuel consumption and increasing power after the idling operation of the engine.

Still further, in the present embodiment, when the oil control valve 11 is switched from the operation mode of the normal operation (including the idling operation) to the largest delay angle mode of the heavy load operation, the oil valve 11 once passes the normal advance angle mode. In this case, when the oil control valve 11 passes the normal advance angle mode, the hydraulic pressure in the advance angle chamber 8 is temporarily increased and thus the hydraulic pressure in the advance angle chamber 8 is applied to the rotor 5 in the direction that pushes the rotor 5 to the advance angle side. For this reason, for example, when the operation mode is switched from the normal delay angle mode to the largest delay angle mode, it is possible to cancel the hydraulic pressure in the delay angle chamber 7 applied to the delay angle restricting pin 18 via the rotor 5, and thus it is possible to smoothly push down the delay angle restricting pin 18 to the retracted position.

Incidentally, when the rotor 5 is at the normal delay angle position, since the rotor 5 receives the hydraulic pressure in the delay angle chamber 7 to push the delay angle restricting pin 18, there is the possibility that the attitude of the delay angle restricting pin 18 is slanted. Then, there may be provided a wall part 31 (see FIG. 2) for supporting the delay angle restricting pin 18 in the direction opposite to the direction in which the rotor 5 abuts against the delay angle restricting pin 18 when the delay angle restricting pin 18 is pushed out to the restricting position. According to this, the wall portion 31 can receive the pushing force that the delay angle restricting pin 18 receives from the rotor 5 and therefore it is possible to stabilize the attitude of the delay angle restricting pin 18 and thus to realize a smooth motion of the delay angle restricting pin 18.

Second Embodiment

Figure 9:
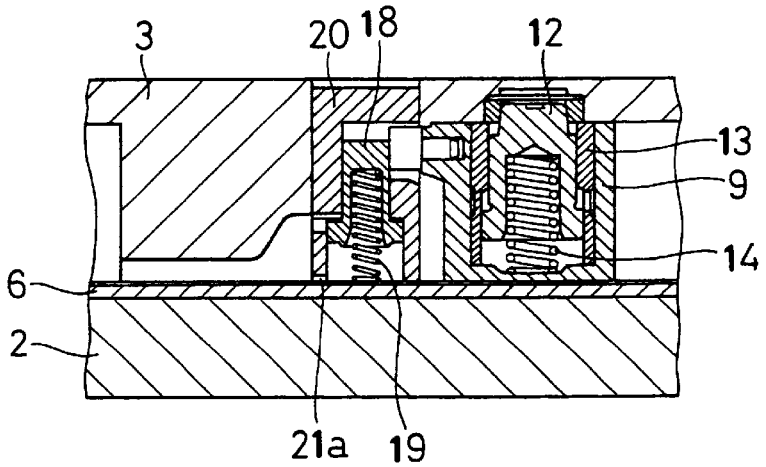
FIG. 9 is a cross sectional view of a VVT in accordance with a second embodiment of the present invention.

Since the control chambers (the first control chamber 16 and the second control chamber 17) are formed in the sleeve 20 incorporated in the case 3 in the above embodiment, the orifice 21*a* provided in the oil passage 21 communicating with the first control chamber 16 from the delay angle chamber 7 may be provided in the sleeve 20. In this case, for example, as shown in FIG. 9, it is possible to form the first hydraulic pressure introducing port 16*a* opening to the first control chamber 16 as the orifice 21*a*.

Third Embodiment

Figure 10:
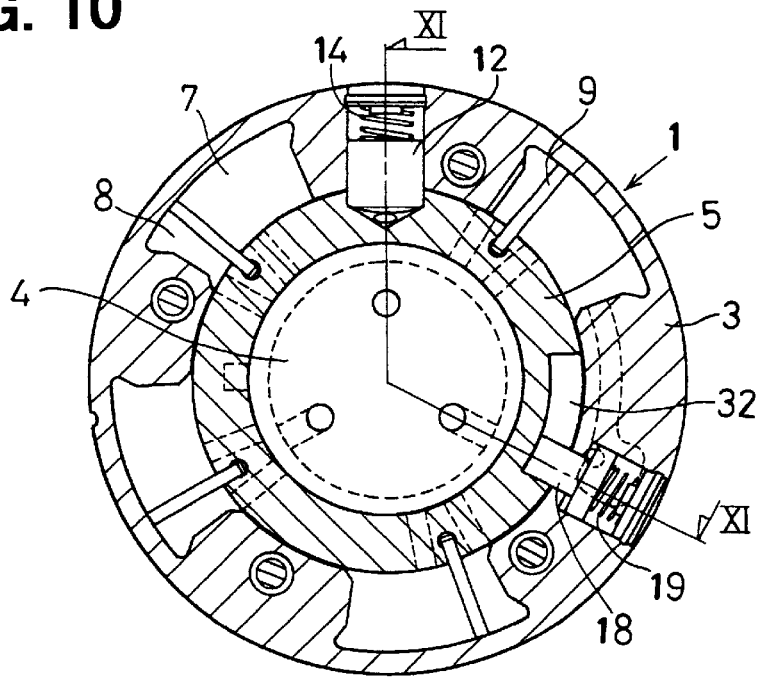
FIG. 10 is a cross sectional view of a VVT in accordance with a third embodiment of the present invention.
Figure 11:
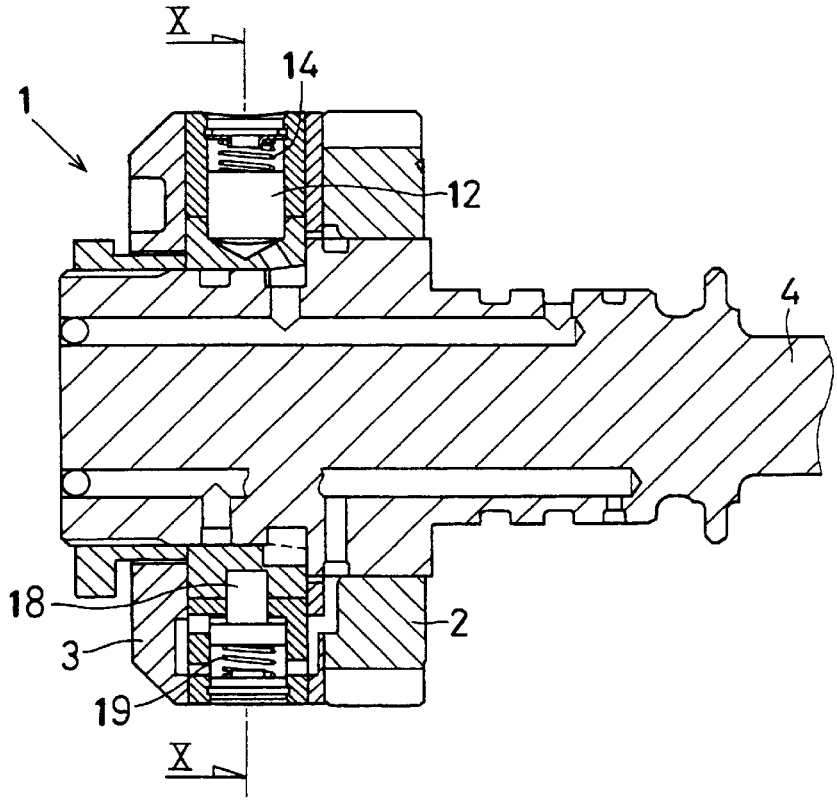
FIG. 11 is a cross sectional view taken on a line XI—XI of FIG. 10.

FIG. 10 is a cross sectional view of a VVT 1 (cross sectional view taken on a line X—X in FIG. 11) and FIG. 11 is a cross sectional view taken on a line XI—XI in FIG. 10.

The VVT 1 of the present embodiment is one example having a configuration in which the delay angle restricting pin 18 of the rotor rotation restricting unit can move in the radial direction.

In the rotor rotation restricting unit, as shown in FIG. 10 and FIG. 11, the delay angle restricting pin 18 can move in the radial direction with respect to the rotor 5 and can retractably move between the restricting position that blocks the rotational path of the rotor 5 and the retracted position that allows the rotor 5 to rotate.

The rotor 5 has an arc-shaped clearance groove (see FIG. 10) made within a predetermined angle range on its outer peripheral surface. This clearance groove 32 is made so as to allow the rotor 5 to rotate in the state where the delay angle restricting pin 18 is pushed out to the restricting position. In other words, the rotor 5 can rotate relatively to the case 3 between the normal delay angle position where one end in the circumferential direction of the clearance groove 32 abuts against the delay angle restricting pin 18 and normal advance angle position where the other end in the circumferential direction of the clearance groove 32 abuts against the delay angle restricting pin 18.

Further, when the delay angle restricting pin 18 is pushed down to the retracted position, the rotor 5 can rotate further to the delay angle side beyond the normal delay angle position.

In this connection, as is the case with the delay angle restricting pin 18, also the lock pin 12 may be move in the radial direction. Also in the present configuration, preventing the rotation of the rotor 5 or releasing the prevention of the rotation of the rotor 5 by the rotor rotation restricting unit can be performed by switching the operation mode of the oil control valve 11, so that it is possible to produce the same effect as in the first embodiment.

Fourth Embodiment

Figure 12:
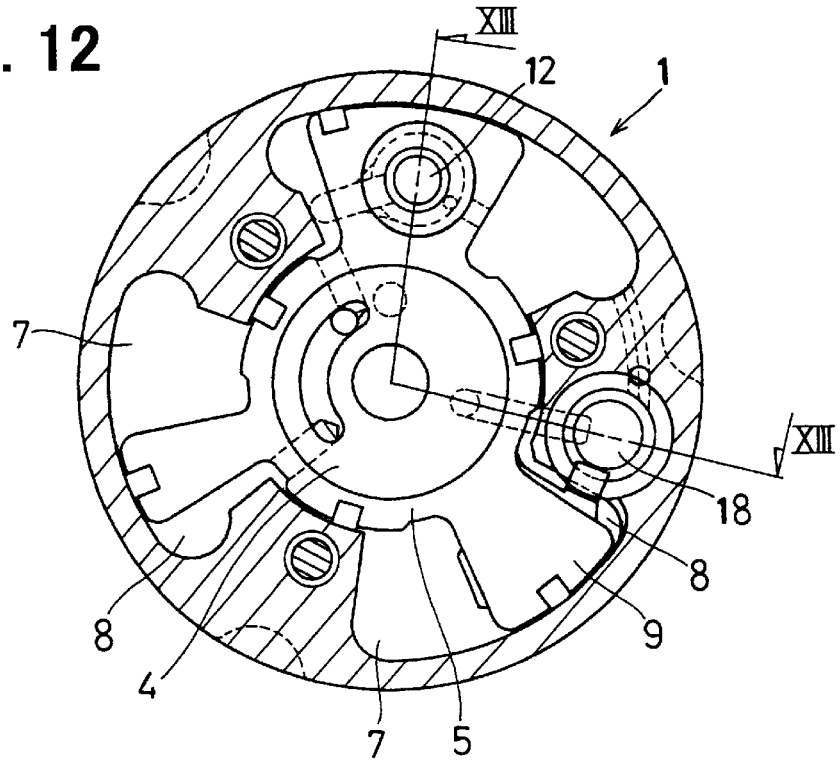
FIG. 12 is a cross sectional view of a VVT in accordance with a fourth embodiment of the present invention.
Figure 13:
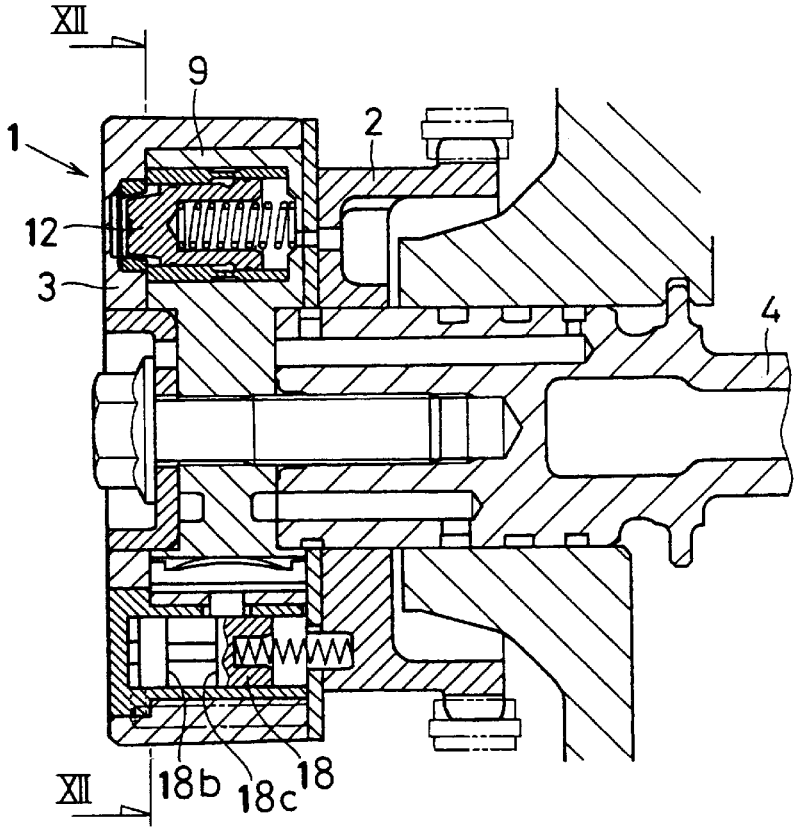
FIG. 13 is a cross sectional view taken on a line XIII—XIII of FIG. 12.
Figure 14:
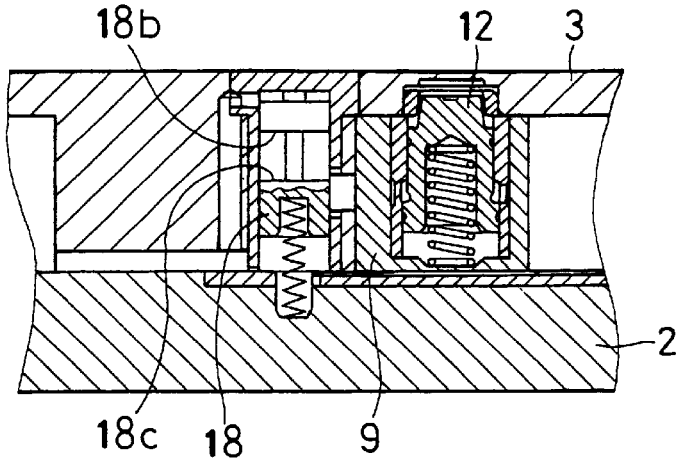
FIG. 14 is a cross sectional view of a VVT in accordance with a fifth embodiment of the present invention.

FIG. 12 is a cross sectional view of a VVT 1 (cross sectional view taken on a line XII—XII in FIG. 11) and FIG. 13 is a cross sectional view taken on a line XIII—XIII in FIG. 12. FIG. 14 is a cross sectional view of the vicinity of a rotor rotation restricting unit and a lock pin 12.

The VVT 1 of the present embodiment is one example related to a structure in which the delay angle restricting pin 18 of the rotor rotation restricting unit is not affected by the hydraulic pressure of an advance angle chamber 8.

The delay angle restricting pin 18, as shown in FIG. 13, has the first pressure receiving surface 18*b* and the second pressure receiving surface 18*c* which receive the hydraulic pressure of the advance angle chamber 8 in the direction of its own operation (in the left and right direction in FIG. 13) in the state where the it is pushed out to the restricting position, and the first pressure receiving surface 18*b* and the second pressure surface 18*c* are equal in area and are opposed to each other in the direction of their own motion.

In the VVT 1 described in the first embodiment, when the delay angle restricting pin 18 is pushed out to the restricting position, the hydraulic pressure in the advance angle chamber 8 acts on the delay angle restricting pin 18 in the direction that pushes down the delay angle restricting pin 18. Here, when the hydraulic oil is supplied to the advance angle chamber 8 so as to rotate the rotor 5 to the advance angle side, the hydraulic pressure in the advance angle chamber 8 applied to the delay angle restricting pin 18 is increased and thus there is a case where the delay angle restricting pin 18 receiving the hydraulic pressure is pushed down to the retracted position. In the case where the VVT 1 is switched to the normal delay angle mode right after that, there is the possibility that the rotor 5 might rotate to the largest delay angle side beyond the normal delay angle position before the delay angle restricting pin 18 is pushed out to the restricting position. Therefore, by providing the delay angle restricting pin 18 with the first pressure receiving surface 18*b* and the second pressure receiving angle 18*c* such that they are opposed to each other in the direction of their motion, it is possible to prevent the hydraulic pressure in the advance angle chamber 8 from affecting the motion of the delay angle restricting pin 18 and thus to prevent a malfunction of the delay angle restricting pin 18.

Fifth Embodiment

The fifth embodiment shown in FIG. 14 is different in the positions of the VVT 1 and the lock pin 12 from the VVT 1 shown in FIG. 12 and FIG. 13. The vane 9 that abuts against the delay angle restricting pin 18 when the rotor 5 is at the normal delay angle position is provided with the lock pin 12. The delay angle restricting pin 18 of the fifth embodiment has the same structure and can produce the same effect as that of the fourth embodiment.

Six Embodiment

Figure 15:
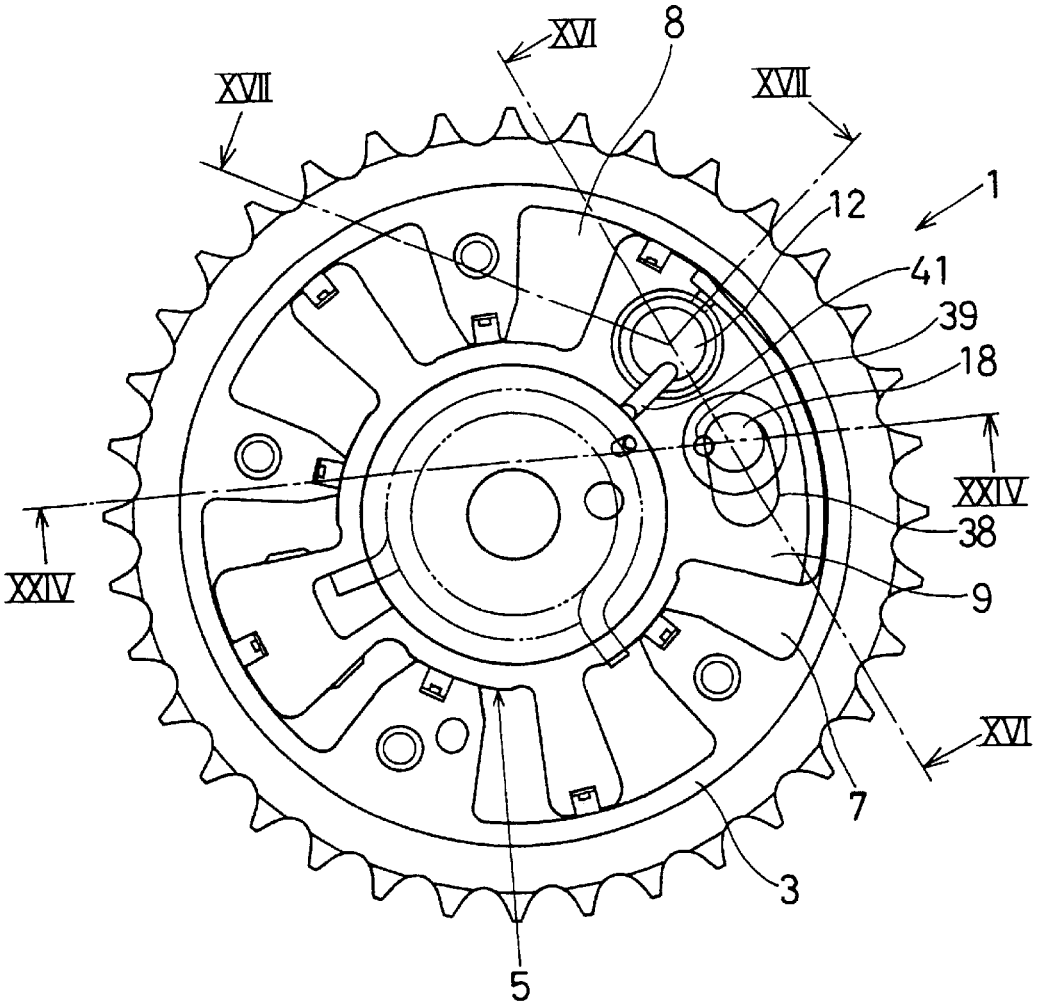
FIG. 15 is a cross sectional view of a VVT in accordance with a sixth embodiment of the present invention.

FIG. 15 is a front view in the axial direction of a VVT 1. The VVT 1 of the present embodiment has a delay angle restricting pin 18 and a lock pin 12 which are incorporated in the same vane 9 and has a hydraulic control valve 34 (see FIG. 18) for controlling the hydraulic pressure in a control chamber 33 (see FIG. 16) for receiving the delay angle restricting pin 18 aside from an oil control valve 11 for controlling the hydraulic pressure in a hydraulic chamber (a delay angle chamber 7 and an advance angle chamber 8). Here, the delay angle restricting pin 18 and the lock pin 12 are opposite to each other in the direction of their motion.

The hydraulic control valve 34 moves a built-in spool (not shown) to adjust the direction of flow (supply and discharge) of the hydraulic oil and the amount of the hydraulic oil, as is the case with the oil control valve 11, and has an electromagnetic actuator 34A for driving the spool by an electromagnetic force.

Figure 18:
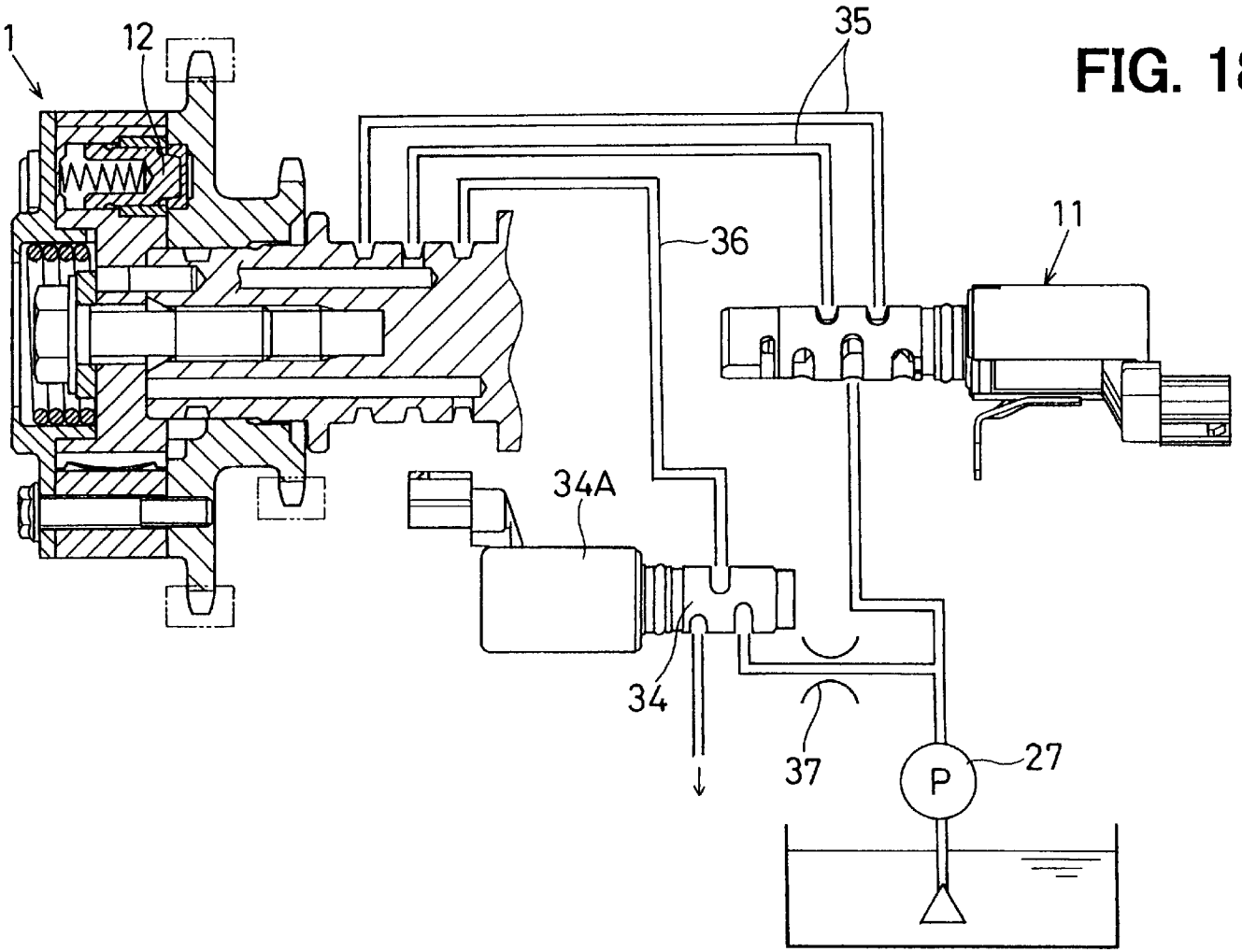
FIG. 18 is a configuration of a VVT system in accordance with the sixth embodiment of the present invention.

This hydraulic control valve 34, as shown in FIG. 18, controls the hydraulic pressure in the control chamber 33 through an exclusive oil passage 36 made in a system different from an oil passage 35 communicating with the hydraulic chamber. The exclusive oil passage 36 (between the hydraulic pump 27 and the hydraulic control valve 34) is provided with an orifice 37.

Figure 16:
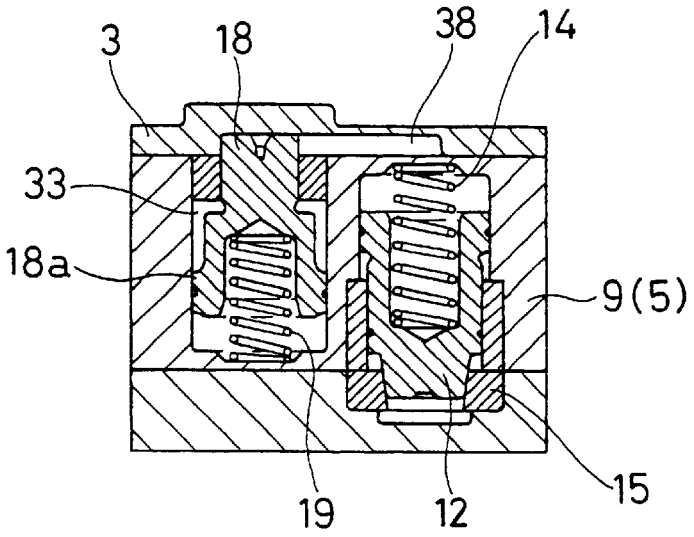
FIG. 16 is a cross sectional view taken on a line XVI—XVI of FIG. 15.

The delay angle restricting pin 18, as shown in FIG. 16, has a collar-shaped pressure receiving portion 18*a* at its rear end portion and is incorporated in the vane 9 in a state where the pressure receiving portion 18*a* is received in the control chamber 33 in such a way as to be in sliding contact with the inner circumferential surface of the control chamber 33 and where the head portion of the delay angle restricting pin 18 is projected liquid-tightly from the control chamber 33. Here, the area of the pressure receiving portion 18*a* is larger than the area of the tip end surface of the delay angle restricting pin 18.

Further, in a case 3 is formed a delay angle restricting groove 38 (see FIG. 15) which is shaped like an arc and guides the head portion of the delay angle restricting pin 18 in such a way that a rotor 5 can rotate to the advance angle side by a predetermined angle range from the normal delay angle position in a state where the head portion of the delay angle restricting pin 18 is projected from the vane 9.

When the lock pin 12, as is the case of the first embodiment, is urged and pushed out by a spring 14 when an engine stops, the head portion of the delay angle restricting pin 18 is fitted in a bush 15 to lock the rotor 5 at "the normal delay angle position".

Figure 17:
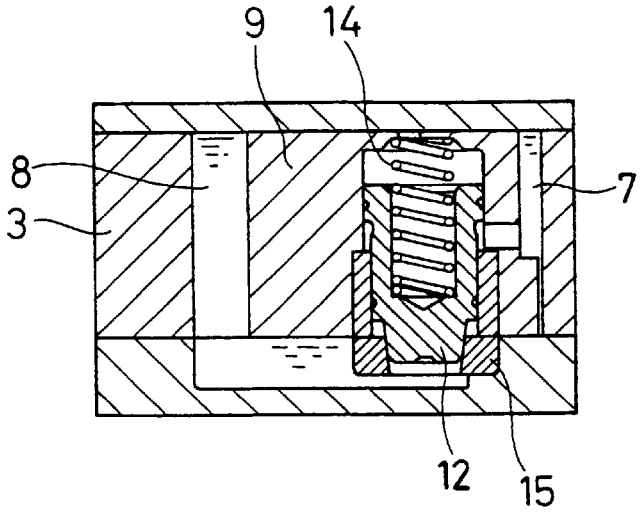
FIG. 17 is a cross sectional view taken on a line XVII—XVII of FIG. 15.

Further, as shown in FIG. 17, while the engine is operating, at least one of the hydraulic pressure of the delay angle chamber 7 and the pressure of the advance angle chamber 8 is applied to the lock pin 12 in the direction that pushes down the lock pin 12 and overcomes the urging force of the spring 14 to release the head portion of the delay angle restricting pin 18 from the bush 15 to thereby allow the rotor 5 to rotate.

Figure 19:
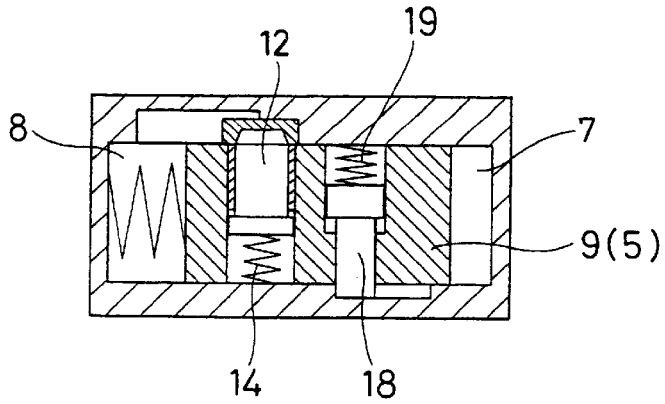
FIG. 19 is a cross sectional view to show the state where the engine stops.

Next, the operation of the VVT 1 of the present embodiment will be described.

a) When the engine stops (see FIG. 19)

Figure 20:
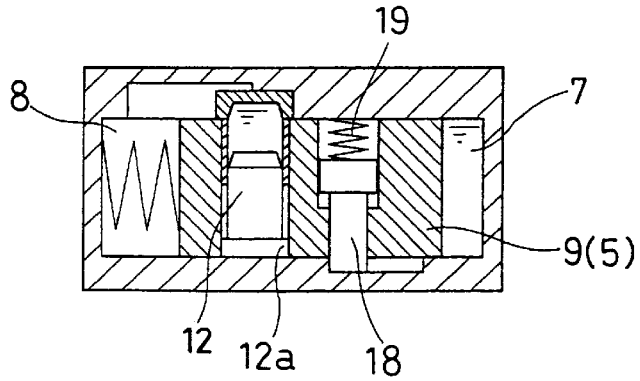
FIG. 20 is a cross sectional view to show the state where the engine starts, is idling, and is going to stop.

When the engine stops, the hydraulic oil is discharged from the hydraulic chamber (the delay angle chamber 7 and the advance angle chamber 8) and thus the rotor 5 is locked at the normal delay angle position (intermediate phase) by the lock pin 12 to prevent the rotor 5 from fluttering.

b) When the engine starts and idles and before the engine stops (see FIG. 20)

Figure 21:
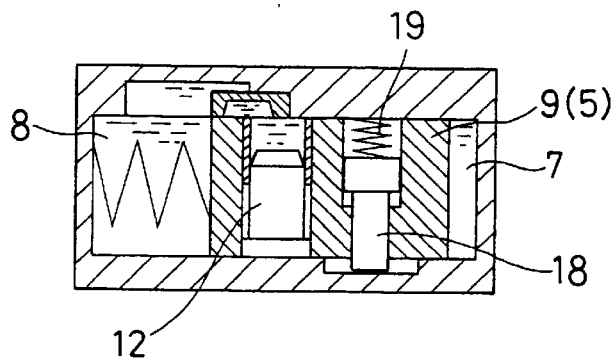
FIG. 21 is a cross sectional view to show the state where the engine operate under normal load.

The hydraulic pressure is introduced into the delay angle chamber 7 by the oil control valve 11 and the hydraulic pressure is applied to the collar portion 12*a* of the lock pin 12 to push down the lock pin 12 to thereby release the prevention of rotation of the rotor 5 by the lock pin 12. However, the delay angle restricting pin 18 is urged by a spring 19 to project its head portion from the vane 9 to prevent the rotor 5 from rotating further to the delay angle side beyond the normal delay angle position, whereby the rotor 5 is kept at the normal delay angle position.

c) When the engine operates under normal load (see FIG. 21)

Figure 22:
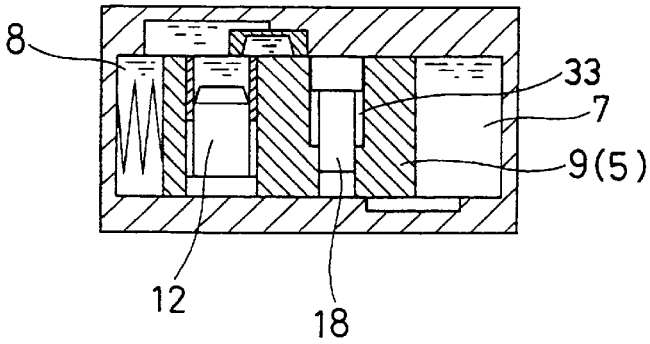
FIG. 22 is a cross sectional view to show the state where the engine operates under heavy load.

The hydraulic pressure is introduced into the delay angle chamber 7 and the advance angle chamber 8 according to the state of operation of the engine. Thereby, the rotor 5 can move from the normal delay angle position to the advance angle side. However, since the delay angle restricting pin 18 is urged by the spring 19 to keep the state where its head portion is projected from the vane 9, the rotor 5 can not rotate further to the delay angle side beyond the normal delay angle position. That is, the rotor 5 can rotate only to the advance angle side from the normal delay angle position.

d) When the engine operates under heavy load (see FIG. 22)

The hydraulic pressure in the delay angle chamber 7 is made larger than it is when the engine operates under normal load and the hydraulic pressure is introduced into the control chamber 33 by the hydraulic control valve 34. Thereby, the delay angle restricting pin 18 is pushed into the vane 9 to enable the rotor 5 to rotate further to the delay angle side beyond the normal delay angle position.

Also in the constitution of the present embodiment, as is the case with the first embodiment, it is possible to realize the most suitable valve timing when the engine starts and the most suitable valve timing for improving fuel consumption and increasing power after the engine idles.

Further, in the present embodiment, aside from the oil control valve 11 for controlling the hydraulic pressure of the VVT 1, there is provided the hydraulic control valve 34 for controlling the hydraulic pressure introduced into the control chamber 33 through the exclusive oil passage 36, so that it is possible to independently control the phase of the rotor 5 and the delay angle restricting pin 18. In this manner, by reducing the force of the spring for urging the delay angle restricting pin 18 in the relationship between the hydraulic force at a high oil temperature and at a low rotational speed and the force of the spring, it is possible to prevent the delay angle restricting pin 18 from being caught during the change of the phase.

Still further, since the hydraulic control valve 34 is required to control only the hydraulic pressure introduced into the control chamber 33, the hydraulic control valve 34 can have, for example, a simple control mode of only switching on or off a solenoid. As a result, it is possible to simplify the structure of the hydraulic control valve 34 and to improve its reliability.

Still further, by providing an oil passage from the hydraulic pump 27 to the hydraulic control valve 34 with the orifice 37, it is possible to prevent the hydraulic pressure of the control chamber 33 from changing in accordance with the variation in rotation of the engine and thus to stably control the motion of the delay angle restricting pin 18.

Since the area of the pressure receiving portion 18*a* is larger than the area of the tip end area in the delay angle restricting pin 18, even if a delay angle pressure or an advance angle pressure is introduced into the delay angle restricting groove 38, it is possible to reduce the effect that the delay angle pressure or the advance angle pressure has on the motion of the delay angle restricting pin 18.

Seventh Embodiment

The present embodiment is an example in which an oil discharging port 39 (see FIG. 23) and a pressure releasing port 40 (see FIG. 24) that eliminates the effect of the hydraulic pressure on the motion of the delay angle restricting pin 18 and a pressure releasing port 41 (see FIG. 25) for eliminating the effect of the hydraulic pressure on the motion of the lock pin 12 are provided in the VVT 1 described in the fourth embodiment.

Figure 23:
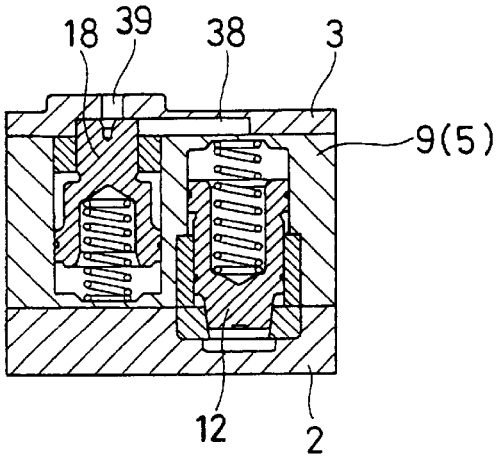
FIG. 23 is a cross sectional view of a VVT in accordance with a seventh embodiment of the present invention and corresponds to a cross sectional view taken on a line XVI—XVI of FIG. 15.

The oil discharging port 39 is provided to discharge the hydraulic oil leaking to the delay angle restricting groove 38 from the delay angle chamber 7 or the advance angle chamber 8 to the outside and, as shown in FIG. 23, communicates with the delay angle restricting groove 38 and makes the head portion of the delay angle restricting pin 18 open to the atmosphere.

Figure 24:
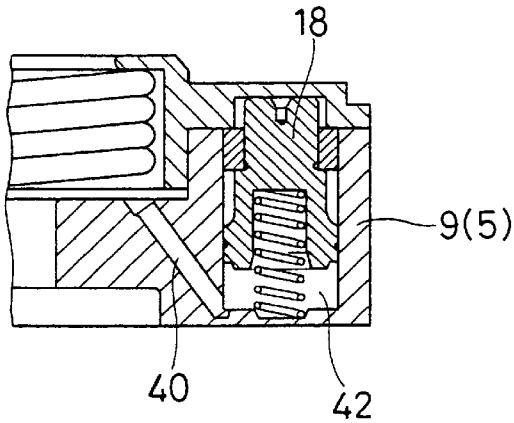
FIG. 24 is a cross sectional view of a VVT in accordance with the seventh embodiment of the present invention and corresponds to a cross sectional view taken on a line XXIV—XXIV of FIG. 15.

The pressure releasing port 40 is provided to discharge the hydraulic oil leaking to the rear end side of the delay angle restricting pin 18 from the control chamber 33 to the outside and, as shown in FIG. 24, makes a space 42 on the rear end side of the delay angle restricting pin 18 open to the atmosphere.

Figure 25:
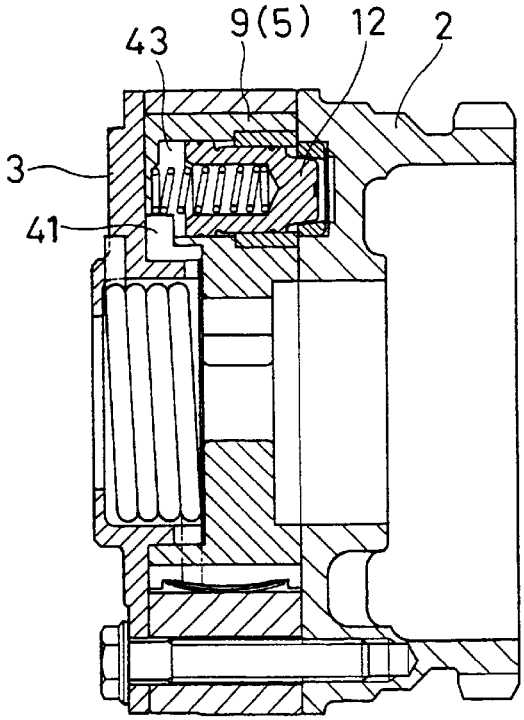
FIG. 25 is a cross sectional view of a VVT in accordance with the seventh embodiment of the present invention.

The pressure releasing port 41 of the lock in 12 is provided to discharge the hydraulic oil leaking to the rear end side of the lock pin 12 from the delay angle chamber 7 or the advance angle chamber 8 to the outside and, as shown in FIG. 25, makes a space 43 on the rear end side of the delay angle restricting pin 18 open to the atmosphere.

Next, the operation and effect of the present embodiment will be described.

For example, when the temperature of the hydraulic oil is increased and the viscosity of the hydraulic oil is decreased, there is the possibility that the hydraulic oil easily leaks from the hydraulic chamber and that leaking hydraulic oil enters the delay angle restricting groove 38 through the gap between the vane 9 and the case 3.

In contrast, when the oil discharging port 39 communicating with the delay angle restricting groove 38 is provided, the hydraulic oil leaking to the delay angle restricting groove 38 from the hydraulic chamber can be discharged to the outside of the VVT 1 from the oil discharging port 39, so that it is possible to eliminate the effect of the hydraulic pressure on the motion of the delay angle restricting pin 18 (the motion when the hydraulic pressure pushes out the delay angle restricting pin 18 from the vane 9).

Further, when the hydraulic oil pushes back the delay angle restricting pin 18 into the vane 9, if the hydraulic oil introduced into the control chamber 33 leaks to the rear end side of the delay angle restricting pin 18, the leaking hydraulic oil acts on the delay angle restricting pin 18 in the direction that pushes out the delay angle restricting pin 18 from the vane 9, so that the hydraulic oil has an effect on the action when the hydraulic oil pushes back the delay angle restricting pin 18 into the vane 9. In contrast, by providing the pressure releasing port 40 for making the space 42 on the rear end side of the delay angle restricting pin 18 open to the atmosphere, the hydraulic oil leaking to the rear end side of the delay angle restricting pin 18 can be discharged to the outside of the VVT 1 from the pressure releasing port 40, so that it is possible to eliminate the effect of the hydraulic pressure on the motion of the delay angle restricting pin 18 (the motion when the hydraulic oil pushes back the delay angle restricting pin 18 into the vane 9).

Still further, by providing the pressure releasing port 41 for making the space 43 on the rear end side of the lock pin 12 open to the atmosphere, the hydraulic oil leaking to the rear end side of the lock pin 12 can be discharged to the outside of the VVT 1 from the pressure releasing port 41, so that it is possible to discharge to eliminate the effect of the hydraulic pressure on the motion of the lock pin 12 (the motion when the hydraulic oil pushes back the lock pin 12 into the vane 9).

Eighth Embodiment

The eighth embodiment will be described with reference to FIG. 26.

The hydraulic pressure in the delay angle restricting groove 38 of the seventh embodiment acts on the delay angle restricting pin 18 so as to push the delay angle restricting pin 18 to a non-restricting position. In order to lock the delay angle restricting pin 18 at the restricting position, it is desirable that the delay angle restricting groove 38 is sealed off the delay angle chamber 7 and the advance angle chamber 8. The delay angle restricting groove 38 can be sealed off both the chambers 7, 8 by the vane 9. However, in order for the vane 9 to cover the delay angle restricting groove 38 over a full variable range, it is necessary to enlarge the vane 9 in the circumferential direction, but the enlarging of the vane 9 prevents the expansion of the variable range.

Figure 26:
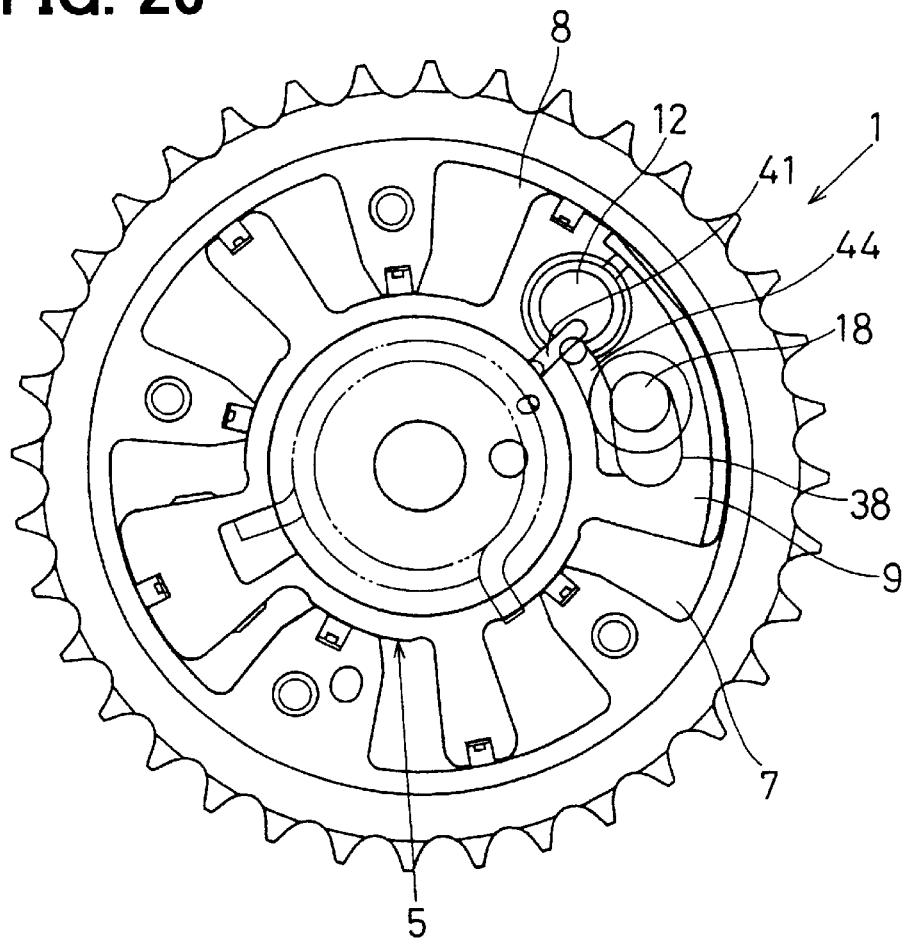
FIG. 26 is a cross sectional view of a VVT in accordance with an eighth embodiment of the present invention.

In the above seventh embodiment and the eighth embodiment shown in FIG. 26, the vane 9 does not cover the delay angle restricting groove 38 in a predetermined range near to the largest delay angle position. This is because even if the delay angle restricting groove 38 communicates with the delay angle chamber 7, the delay angle restricting pin 18 is already at the non-restricting position. In these embodiments, the vane 9 covers the delay angle restricting groove 38 in the range from the largest advance angle position to the position of 10° CA on the delay angle side beyond the normal delay angle position.

Therefore, the delay angle restricting groove 38 is not covered by the vane 9 in the range from the position of 10° CA on the delay angle side beyond the normal delay angle position to the largest advance angle position. This range is set in consideration of the operational response of the delay angle restricting pin 18.

In the eighth embodiment, the delay angle restricting pin 18 is arranged nearer to the advance angle side than the lock pin 12. The lock pin 12 is arranged nearer to the delay angle side than the delay angle restricting pin 18.

In the seventh embodiment, the oil discharging port 39 is provided to discharge the hydraulic oil leaking to the delay angle restricting groove 38 from the hydraulic chamber 33. In the eighth embodiment, in place of the oil discharging port 39, as shown in FIG. 26, a communication groove 44 is provided. When the vane 9 is positioned at least between the largest advance angle position and the normal delay angle position, the communication groove 44 makes the delay angle restricting groove 38 communicate with the pressure releasing port 41.

Ninth Embodiment

Figure 27:
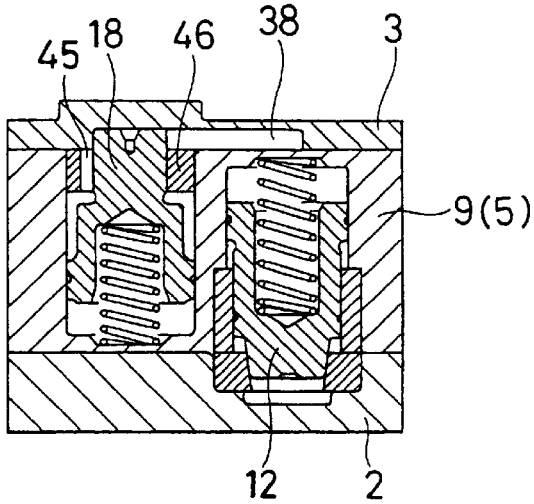
FIG. 27 is a cross sectional view of a VVT in accordance with a ninth embodiment of the present invention.
Figure 28:
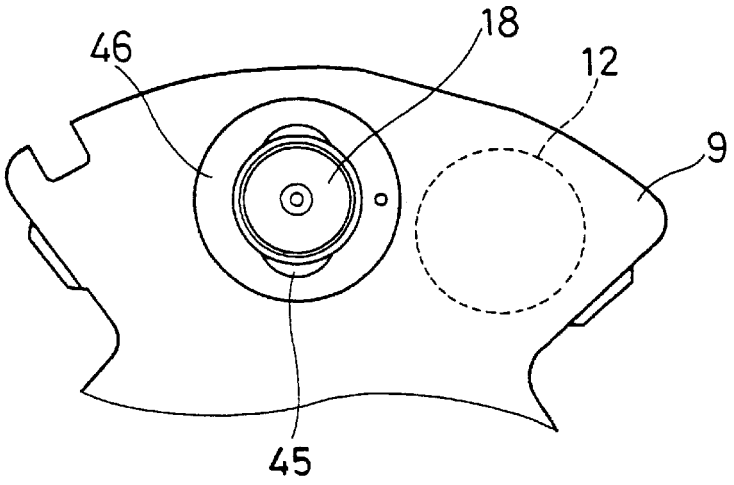
FIG. 28 is a plan view of a vane part of FIG. 27.

FIG. 27 is a cross sectional view to show the vicinity of the delay angle restricting pin 18 and the delay angle restricting pin 18. FIG. 28 is a plan view of the delay angle restricting pin 18 when viewed from the tip end side thereof.

The present embodiment is an example in which a communication groove 45 for making the delay angle restricting groove 38 communicate with the control chamber 33 is formed in place of the oil discharging port 39 shown in the fifth embodiment.

In the vane 9, as shown in FIG. 28, is incorporated a cylindrical bearing 46 for slidably holding the delay angle restricting pin 18 and a communication groove 45 is depressed on the inner circumferential surface of the bearing 46. However, the communication groove 45 is made in the direction nearly perpendicular to the direction of rotation of the rotor 5. The communication groove 45 is made at the position of the bearing 46 where load is relatively light. Thereby, the hydraulic oil leaking to the delay angle restricting groove 38 from the hydraulic chamber (delay angle chamber 7 or the advance angle chamber 8) is introduced into the control chamber 33 through the communication groove 45, so that it is possible to eliminate the effect of the hydraulic pressure on the motion of the delay angle restricting pin 18.

Further, the hydraulic oil introduced into the control chamber 33 through the communication groove 45 is not discharged but is reused, so that it is possible to reduce the amount of the hydraulic oil leaking to the outside.

Still further, when the hydraulic oil is introduced into the control chamber 33 to push back the delay angle restricting pin 18 into the vane 9, the hydraulic oil introduced into the control chamber 33 is flowed to the tip end side of the delay angle restricting pin 18 through the communication groove 45 to act on the delay angle restricting pin 18 in the direction that pushes down the delay angle restricting pin 18 into the vane 9, so that the communication groove 45 is effective for preventing the head of the delay angle restricting pin 18 from being pushed out when the hydraulic pressure is low.

Tenth Embodiment

Figure 29:
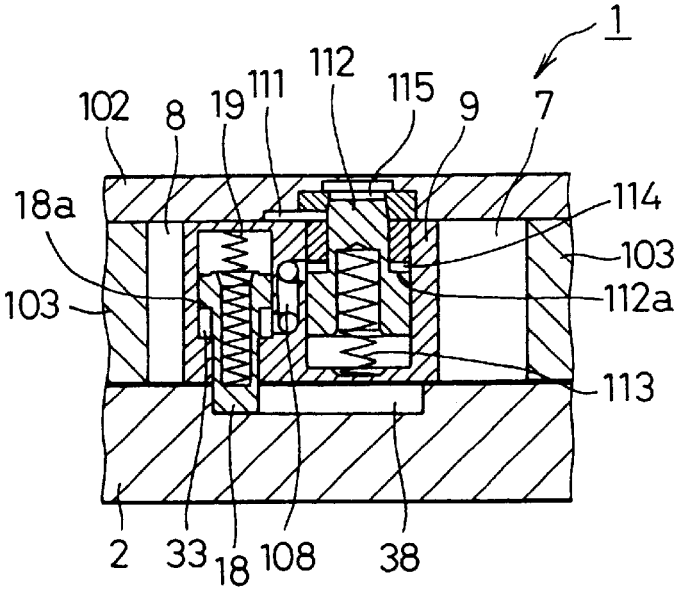
FIG. 29 is a cross sectional view of a VVT in accordance with a tenth embodiment of the present invention and shows a cross sectional view taken on a line XXIX—XXIX of FIG. 30.
Figure 30:
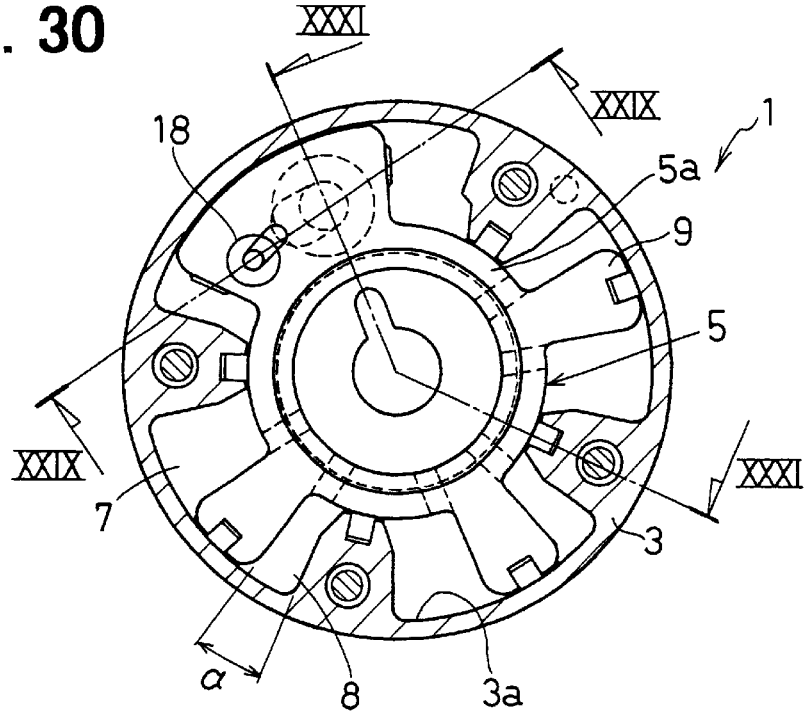
FIG. 30 is a cross sectional view of a VVT in accordance with the tenth embodiment of the present invention and shows a cross sectional view taken on a line XXX—XXX of FIG. 31.
Figure 31:
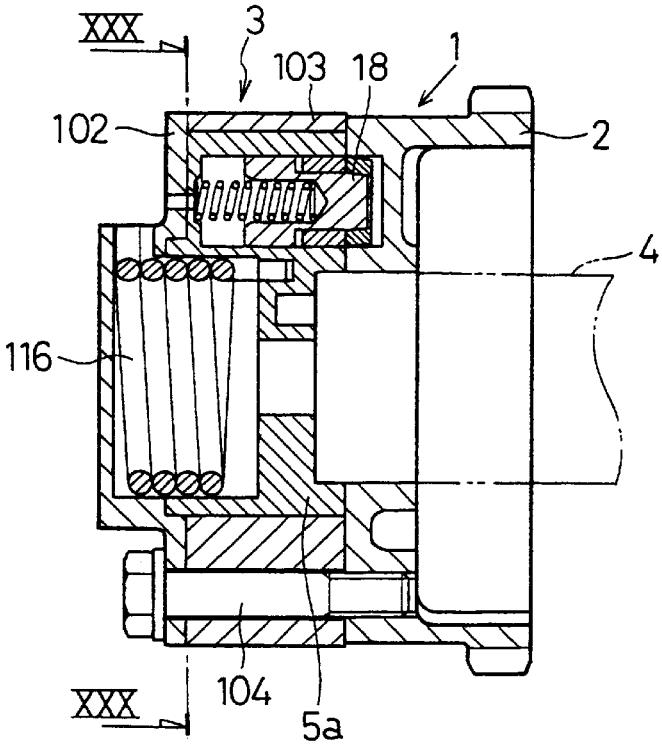
FIG. 31 is a cross sectional view taken on a line XXXI—XXXI of FIG. 30.
Figure 32:
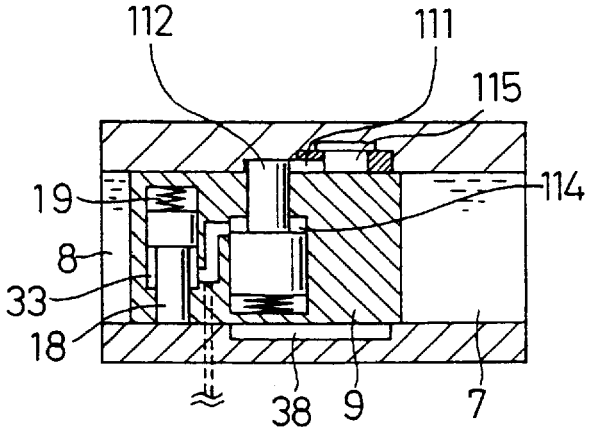
FIG. 32 is a cross sectional view to show a state where a VVT is at the largest delay angle position.
Figure 33:
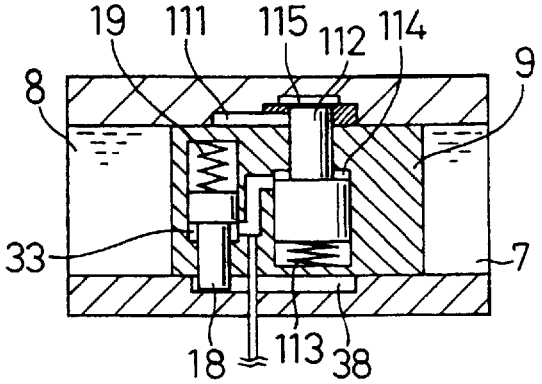
FIG. 33 is a cross sectional view to show a state where a VVT is locked.
Figure 34:
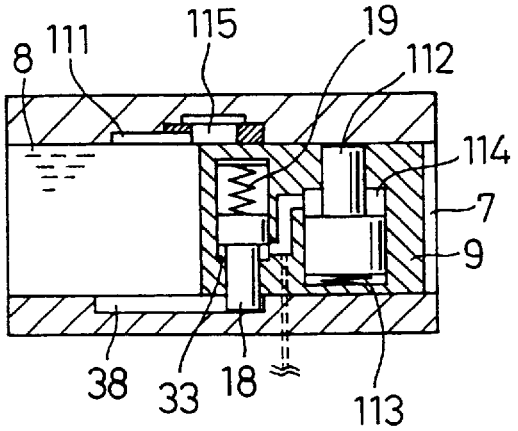
FIG. 34 is a cross sectional view to show a state where a VVT is at the largest advance angle position.
Figure 35:
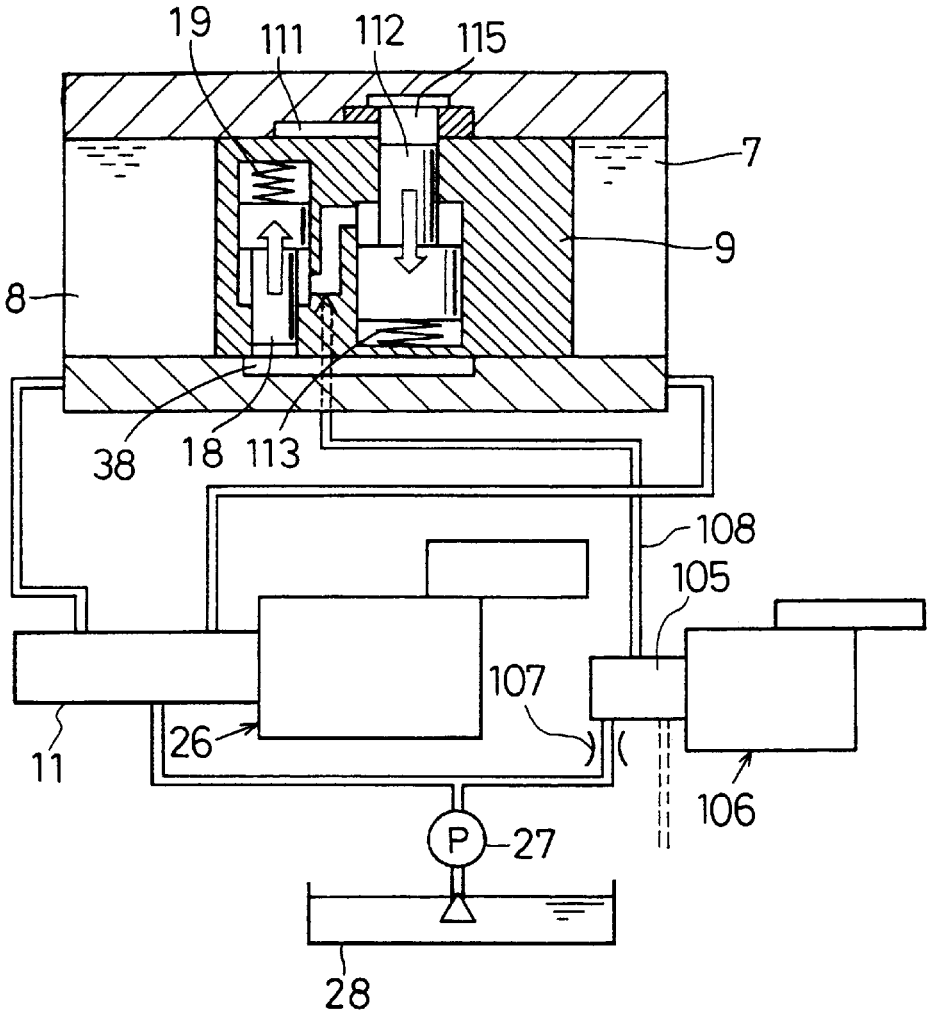
FIG. 35 is a hydraulic circuit diagram to show the hydraulic circuit of a VVT.

FIG. 29 is a cross sectional view of a rotation restricting unit of a VVT. FIG. 30 is a cross sectional view of the VVT (cross sectional view taken on a line XXX—XXX in FIG. 31). FIG. 31 is a cross sectional view taken on a line XXXI—XXXI in FIG. 30. FIGS. 32, 33, 34 are cross sectional views to show the operational state of the VVT. FIG. 35 shows a hydraulic circuit.

The VVT 1 is provided with a rotor rotation restricting unit for restricting the rotation of a rotor 5. A case 3 has a cylindrical portion 103 and an end cover 102 which are fixed to a sprocket 2 with a bolt 104.

The rotor rotation restricting unit constitutes a delay angle restricting mechanism for preventing the rotor 5 from rotating to the delay angle side beyond "the normal delay angle position" and an advance angle restricting mechanism for preventing the rotor 5 from rotating to the advance angle side beyond "the normal delay angle position".

Here, the above "normal delay angle position" means an intermediate phase position where the rotor 5 is rotated by a predetermined angle alpha $\alpha$ to the advance angle side from the largest delay angle position of the rotor 5.

The delay angle restricting mechanism has a delay angle restricting groove 38 made on the sprocket 2, a delay angle restricting pin 18 retractably incorporated in the vane 9, and a spring 19 for urging the delay angle restricting pin 18 in the direction that pushes out the delay angle restricting pin 18 from the vane 9. In the vane 9 is provided an exclusive oil passage 108 which is different from an oil passage for introducing the hydraulic oil into a hydraulic chamber (a delay angle chamber 7 and an advance angle chamber 8). The hydraulic oil is introduced into a control chamber 33 through an exclusive oil passage 108 to push down the delay angle restricting pin 13 into the vane 9. The hydraulic oil is supplied to or discharged from the exclusive oil passage 108 by a hydraulic control valve 105 shown in FIG. 35. The hydraulic control valve 105 has an electromagnetic actuator 106. Further, an orifice 107 is provided in the oil passage for supplying the hydraulic oil.

The delay angle restricting groove 38 is formed in the shape of an arc such that the head portion of the delay angle restricting pin 18 pushed out from the vane 9 can be fitted therein and moved within a predetermined angular range. When the delay angle restricting pin 18 abuts against the end portion on the delay angle side of the delay angle restricting groove 38, the rotor 5 is at the normal delay angle position.

The delay angle restricting pin 18 has a collar-shaped pressure receiving portion 18*a* at the rear end portion thereof. The pressure receiving portion 18*a* is received in the control chamber 33 in such a way as to be in sliding contact with the inner peripheral surface thereof and the head portion of the delay angle restricting pin 18 is projected fluid-tightly from the control chamber 33.

The advance angle restricting mechanism has an advance angle restricting groove 111 made on a cover 102, an advance angle restricting pin 112 retractably incorporated in the vane 9, and a spring 113 for urging the advance angle restricting pin 112 in the direction that pushes out the advance angle restricting pin 112 from the vane 9. A control chamber 114 into which the hydraulic oil is introduced through the exclusive oil passage 108 to push down the advance angle restricting pin 112 into the vane 9 is partitioned between the advance angle restricting pin 112 and the vane 9. The hydraulic oil introduced into the control chamber 114 is controlled by the hydraulic control valve 105.

The advance angle restricting mechanism 111 is formed in the shape of an arc such that the head portion of the advance angle restricting pin 112 pushed out from the vane 9 is fitted therein and moved within a predetermined angular range. When the advance angle restricting pin 112 abuts against the end portion on the advance angle side of the advance angle restricting groove 111, the rotor 5 is at the normal advance angle position.

The advance angle restricting pin 112 has a collar-shaped pressure receiving portion 112*a* at the rear end portion thereof. The pressure receiving portion 112*a* is received in the control chamber 114 in such a way as to be in sliding contact with the inner peripheral surface thereof and the head portion of the advance angle restricting pin 112 is projected fluid-tightly from the control chamber 114.

The delay angle restricting pin 18 and the advance angle restricting pin 112 are incorporated in the same vane 9 and are constituted such that they are opposite to each other in the operational direction projecting from the vane 9. Further, in both the restricting pins 18, 112, the areas of the pressure receiving portions 18*a*, 112*a* for receiving the hydraulic pressure are larger than the areas of the pin tip ends.

The control chamber 33 of the delay angle restricting mechanism communicates with the control chamber 114 of the advance angle restricting mechanism through the exclusive oil passage 108. The exclusive oil passage 108 is common to the control chambers 33, 114.

The advance angle restricting pin 112 also function as a lock pin for locking the rotor 5 at the normal delay angle position when the engine stops. That is, the sprocket 2 has a ring-shaped lock depressed portion 115 formed at the end portion of the advance angle restricting groove 111 against which the advance angle restricting pin 112 abuts. The hollow portion of the lock depression 115 is depressed more deeply than the advance angle restricting groove 111. Therefore, when the rotor 5 rotates to the advance angle side from the delay angle side and the head of the advance angle restricting pin 112 is guided by the advance angle restricting groove 111 to the end portion of the advance angle restricting groove 111, the advance angle restricting pin 112 urged by a spring 113 is deeply fitted in the lock depression 115. As a result, the advance angle restricting pin 112 is inhibited from moving to the delay angle side and the advance angle side, whereby the rotor 5 is locked at the normal delay angle position. The phase (position of the rotor 5) in which the advance angle restricting pin 112 can be fitted in the lock depression 115 is called a lock phase.

Next, the operation of the present embodiment will be described.

a) When the engine operates under normal operation

A valve timing required at the idling operation is nearer to the delay angle side than the lock phase of the VVT 1. For this reason, when the engine is stopped, it is necessary to advance the VVT 1 to the lock phase. Therefore, it is possible to employ the following procedure: an advance angle control is performed at the same time when an ignition is turned off to advance an angle to a predetermined phase, and then the fuel is cut and the ignition is cut to stop the engine.

In the present operation, the advance angle control is performed at the same time when the ignition is turned off and the hydraulic pressure in the exclusive oil passage 108 is released to a drain by the hydraulic control valve 105 to fit the advance angle restricting pin 112 in the advance angle restricting groove 111. The advance angle restricting pin 112 abuts against the end portion of the advance angle restricting groove 111 to stop the rotation of the rotor 5 and the advance angle restricting pin 112 is fitted in the lock depression 115 to lock the rotor 5 in the lock phase.

b) When the rotor 5 stops on the advance angle side

When the VVT 1 stops nearer to the advance angle side than the lock phase because of an engine stall or a system failure, a microcomputer (not shown) stores an over advance angle stop. When the engine starts next, first, the microcomputer operates the VVT 1 under a delay angle control. To be specific, the hydraulic control valve 105 discharges the hydraulic oil in the exclusive oil passage 108 to the drain and the delay angle restricting pin 18 is urged by the spring 19, thereby being fitted in the delay angle restricting groove 38. Since the vane 9 is rotated to the delay angle side by the driving torque of a camshaft 4 also in the state where there is no hydraulic pressure at the starting of the engine, the delay angle restricting pin 18 abuts against the end portion of the delay angle restricting groove 38 to stop the rotation of the rotor 5.

In the relationship between the advance angle restricting pin 112 and the delay angle restricting pin 18, while the advance angle restricting pin 112 is at the lock phase, the delay angle restricting pin 18 is surely at the position slightly nearer to the delay angle side and abuts against the end portion of the delay angle restricting groove 38. When the advance angle restricting pin 112 is prevented from moving in the direction of the delay angle by the delay angle restricting pin 18, the advance angle restricting pin 112 is fitted in the advance angle restricting groove 111. When the vane 9 is moved to the advance angle side in this state by the varying torque of the camshaft 4, the advance angle restricting pin 112 abuts against the end portion of the advance angle restricting groove 111 and can be locked by the lock depression 115.

c) When the rotor 5 stops on the delay angle side

When the VVT 1 stops on the delay angle side because of an engine stall or a system failure, the microcomputer stores an over delay angle stop. The microcomputer operates the VVT 1 under the advance angle control when the engine starts next, and the hydraulic control valve 105 discharges the hydraulic oil of the exclusive oil passage 108 to the drain. The advance angle restricting pin 112 abuts against the end of the advance angle restricting groove 111 to stop the rotation of the rotor 5 and the advance angle restricting pin 112 is fitted in the lock depression 115 to lock the rotor 5 at the lock phase. In the present embodiment, in order to advance the angle of the VVT 1 in the state where the hydraulic pressure is low at the starting of the engine, there is provided a spring 116 for urging the VVT 1 to the advance angle side. In this manner, it is considered that the VVT 1 can be moved to the advance angle side by the spring 116 even when the hydraulic pressure is low at the starting of the engine.

d) When the rotor 5 is released from the prevention of rotation

In the case when the rotor 5 is released from the prevention of rotation by the delay angle restricting pin 18 and the advance angle restricting pin 112, a current is not passed through the solenoid of the hydraulic control valve 105. This makes the hydraulic port of the hydraulic control valve 105 communicate with an inflow port to supply the hydraulic oil pressure-fed by the hydraulic pump 27 to both the control chambers 33, 114. When the hydraulic pressure applied to the delay angle restricting pin 18 and the hydraulic pressure applied to the advance angle restricting pin 112 overcome the urging forces of the spring 19 and the urging force of the spring 113, respectively, as shown in FIG. 35, the delay angle restricting pin 18 and the advance angle restricting pin 112 are pushed down into the vane 9 to release the prevention of rotation of the rotor 5.

Effect of the Present Embodiment

In the present embodiment, the phase control and the control of the delay angle restricting pin 18 and the advance angle restricting pin 112 by the hydraulic control valve 11 are independently performed. By making the forces of the springs 19, 113 smaller than the hydraulic pressure when the engine rotates at low rotational speed and at high oil temperature, it is possible to prevent the delay angle restricting pin 18 and the advance angle restricting pin 112 from being caught during the change of phase. Further, even in the case when the hydraulic pressure is high at high rotational speed or the like, by making the hydraulic control valve 105 open to the atmosphere, it is possible to make the prevention of rotation by the delay angle restricting pin 18 and the advance angle restricting pin 112 effective. In this manner, it is possible to provide the most suitable valve timing.

Further, since two pins of the delay angle restricting pin 18 and the advance angle restricting pin 112 are employed, it is possible to converge the position of the rotor 5 to the lock pin phase from both the advance angle side and the delay angle side with respect to the lock phase and thus to produce a stable lock operation.

In the delay angle restricting mechanism and the advance angle restricting mechanism of the present embodiment, the delay angle restricting pin 18 and the advance angle restricting pin 112 are pushed down into the vane 9 by the hydraulic pressure introduced into the control chambers 33, 114. For this reason, even when the engine speed is low and, in particular, the hydraulic pressure is reduced at the high oil temperature, it is possible to lock the rotor 5 at the position suitable for the next starting of the engine.

Further, since the prevention of rotation of the rotor 5 can be released, it is possible to rotate the rotor 5 to the largest delay angle position, for example, when the engine operates under heavy load.

As a result, it is possible to realize the most suitable valve timing for starting the engine and the most suitable valve timing for improving fuel consumption and increasing power after the engine idles.

In the advance angle restricting mechanism of the present embodiment, the advance angle restricting pin 112 has the function of the lock pin, so that it is not necessary to provide the advance angle restricting pin 112 and the lock pin separately. This can reduce the number of parts and cost. Incidentally, it is possible to make the delay angle restricting pin 18 function as the lock pin.

Since the hydraulic control valve 105 is required to control only the hydraulic oil introduced into the control chambers 33, 114 irrespective of the hydraulic control of the delay angle chamber 7 and the advance angle chamber 8, for example, it is required only to switch on or off the solenoid. As a result, it is possible to simplify the structure of the hydraulic control valve 105 and thus to improve reliability thereof.

Further, since the delay angle restricting pin 18 and the advance angle restricting pin 112 are incorporated in the same vane 9, it is possible to use the exclusive oil passage 108 in common for both the pins and thus to make the exclusive oil passage 108 one oil passage. As a result, the exclusive oil passage 108 can be made through the vane 9. It is possible to prevent the hydraulic oil from leaking from the sliding portion between the vane 9 and the case 3 or the sprocket 2 as compared with the case where an exclusive oil passage is made through the vane 9 from the case 3 side or the sprocket 2 side.

Since the delay angle restricting pin 18 and the advance angle restricting pin 112 are arranged such that their operation directions are opposite to each other, it is possible to functionally provide the delay angle restricting mechanism and the advance angle restricting mechanism. That is, it is easy to secure spaces for both the delay angle restricting groove 38 and the advance angle restricting groove 111 as compared with the case where both the grooves 38, 111 are provided on the same side.

By providing the orifice 107, it is possible to prevent hydraulic variations in the control chambers 33, 114 caused by variations in the rotation of the engine and to stably control the motions of the delay angle restricting pin 18 and the advance angle restricting pin 112.

In the delay angle restricting pin 18 and the advance angle restricting pin 112, the areas of the pressure receiving portions 18*a*, 112*a* are larger than the areas of the tip end portions, respectively, so that it is possible to reduce the effect of the delay angle pressure (hydraulic pressure of the delay angle chamber 7) or the advance angle pressure (hydraulic pressure of the advance angle chamber 8) on the motion of the delay angle restricting pin 18 and the advance angle restricting pin 112 even if the delay angle pressure or the advance angle pressure is introduced into the delay angle restricting groove 38 or the advance angle restricting groove 111.

Further, it is also recommendable that the delay angle pressure or the advance angle pressure is not introduced into the delay angle restricting groove 38 or the advance angle restricting groove 111. In this case, it is possible to stably control the motions of the delay angle restricting pin 18 and the advance angle restricting pin 112 without being affected by variations in the delay angle pressure and the advance angle pressure.

Eleventh Embodiment

Figure 36:
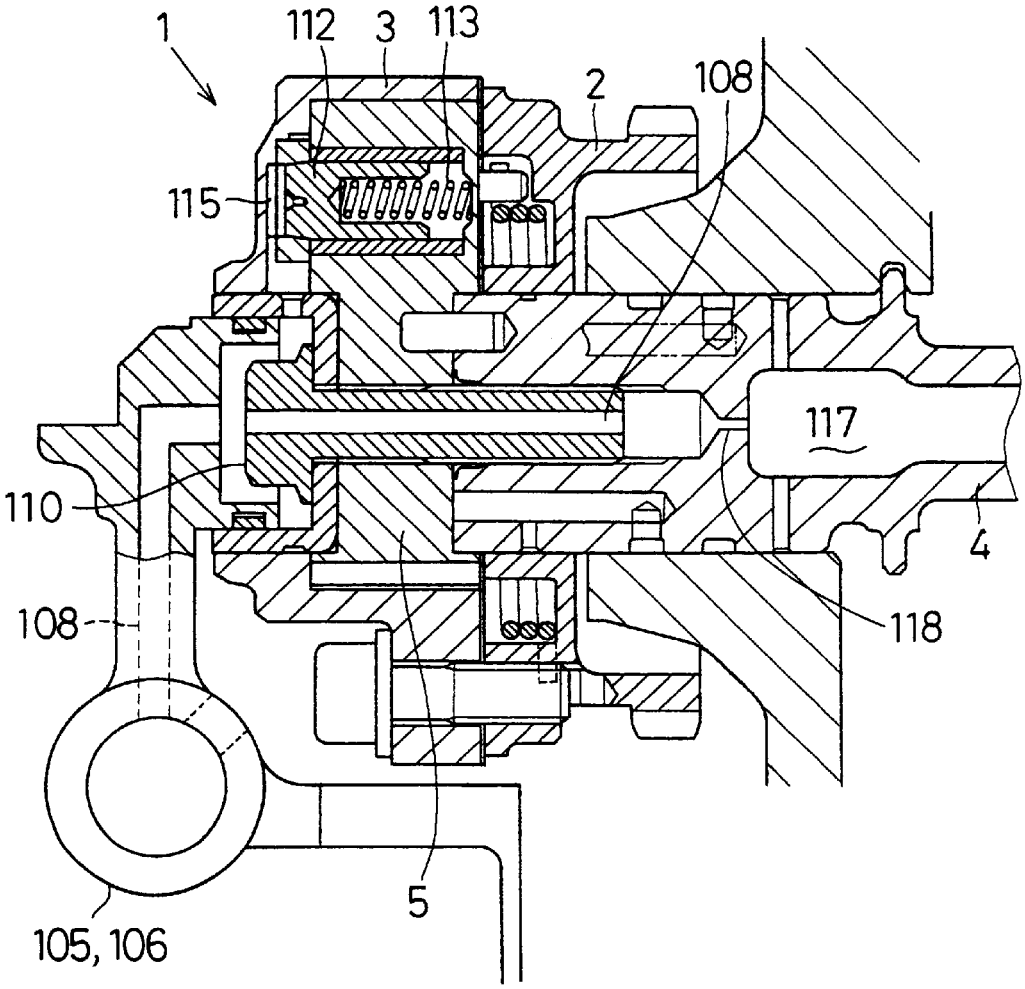
FIG. 36 is a cross sectional view of a VVT in accordance with an eleventh embodiment of the present invention.
Figure 37:
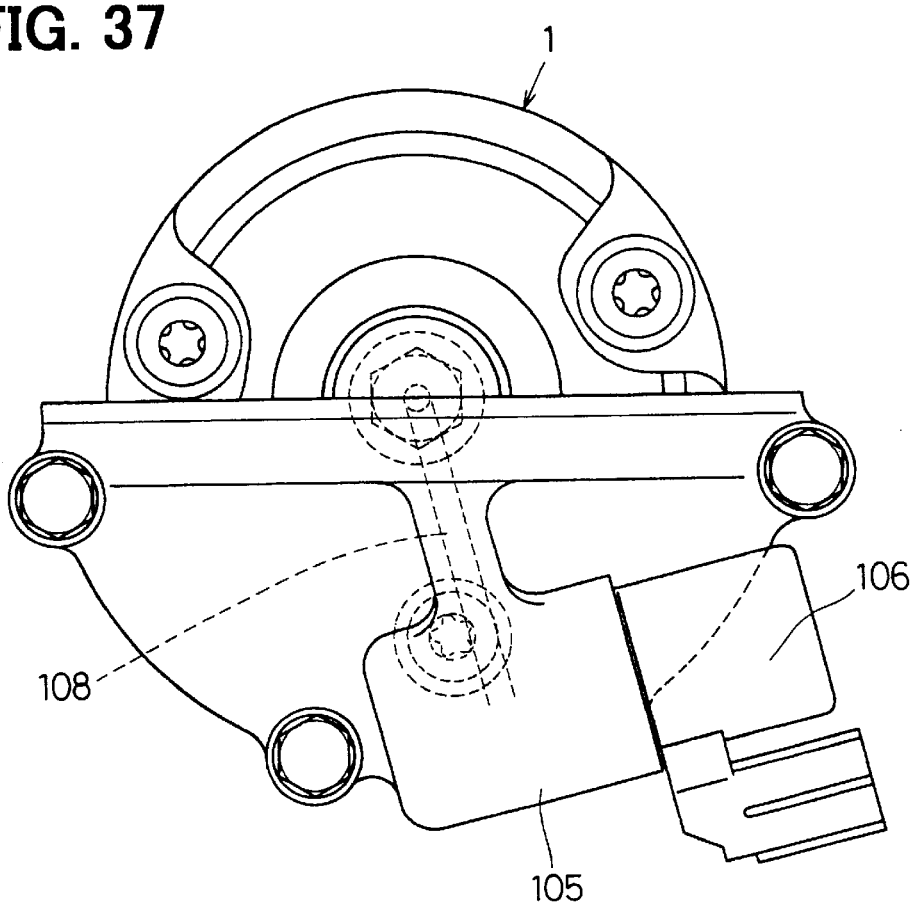
FIG. 37 is a plan view of a VVT in accordance with the eleventh embodiment of the present invention.

FIG. 36 is a cross sectional view of a VVT 1 and FIG. 37 is a front view in the axial direction of the VVT 1. In the VVT 1 of the present embodiment, an exclusive oil passage 108 is formed in a bolt 110 for fixing a rotor 5 and a hydraulic control valve 105 for opening or closing the communication between the exclusive oil passage 108 and a drain space is fixed to the front side (left side of the case 3) of the VVT 1.

The exclusive oil passage 108, as shown in FIG. 36, communicates with an oil reservoir 117 made in a camshaft 4. An orifice 118 is disposed between the exclusive oil passage 108 and the oil reservoir 117. The exclusive oil passage 108 communicates with a lock depression 24 via a housing 3 side.

The hydraulic control valve 105 opens when an advance angle restricting pin 112 (which serves as a lock pin) is fitted in the lock depression 115 to lock the rotor 5 at the normal delay angle position and closes when the prevention of rotation of the rotor 5 by the advance angle restricting pin 112 is released.

Figure 38:
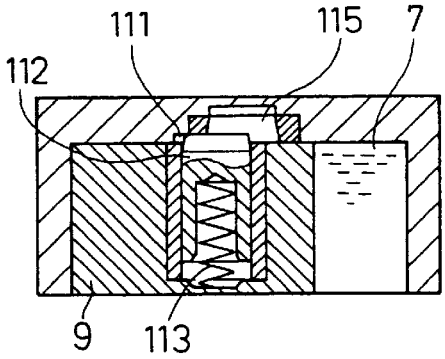
FIG. 38 is a cross sectional view to show a state where a VVT is at the largest delay angle position.
Figure 39:
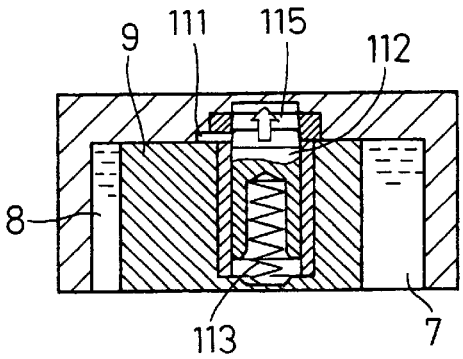
FIG. 39 is a cross sectional view to show a state where a VVT is locked.

For example, as shown in FIG. 38, when the rotor 5 stops on the delay angle side, as is the case with the first embodiment, the VVT 1 is operated under an advance angle control to rotate the rotor 5 to the advance angle side. At this time, the hydraulic control valve 105 opens. Thereby, the advance angle restricting pin 112 is urged by a spring 113 and is projected from a vane 9 and is fitted in an advance restricting groove 111. Thereafter, when the rotor 5 rotates to the normal delay angle position, the advance angle restricting pin 112 abuts against the end portion of the advance angle restricting groove 111 to stop the rotor 5 from rotating and is fitted in the lock depression 115 to lock the rotor 5 at the normal delay angle position (see FIG. 39).

Figure 40:
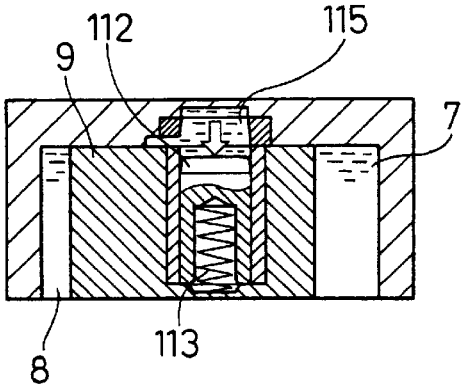
FIG. 40 is a cross sectional view to show a state where a VVT is free.
Figure 41:
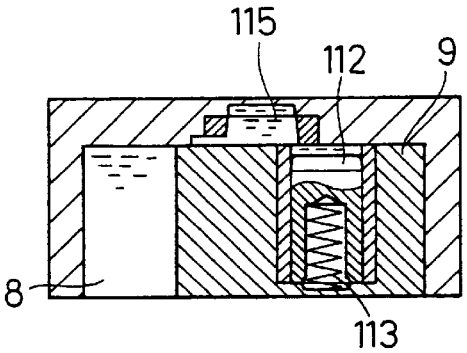
FIG. 41 is a cross sectional view to show a state where a VVT is at the largest advance angle position.

Further, during the normal operation, the hydraulic control valve 105 is closed to introduce the hydraulic oil into the lock depression 115 through the exclusive oil passage 108. As a result, as shown in FIG. 40, the hydraulic pressure is applied to the head portion of the advance angle restricting pin 112 to push down the advance angle restricting pin 112 into the vane 9 against the urging force of the spring 113. Thereby, the rotor 5 is released from the prevention of rotation by the advance angle restricting pin 112 and thus can rotate to the advance angle side or the delay angle side from the normal delay angle position (see FIG. 41).

Incidentally, for example, in the case where an engine is provided with the VVTs 1 on both of the intake side and the exhaust side, or a plurality of VVTs 1, as is the case with a V-type engine, it is also recommendable that the hydraulic control of an advance angle restricting mechanism and a delay angle restricting mechanism provided with the plurality of VVTs 1 are performed by one hydraulic control valve 105.

Twelfth Embodiment

Figure 42:
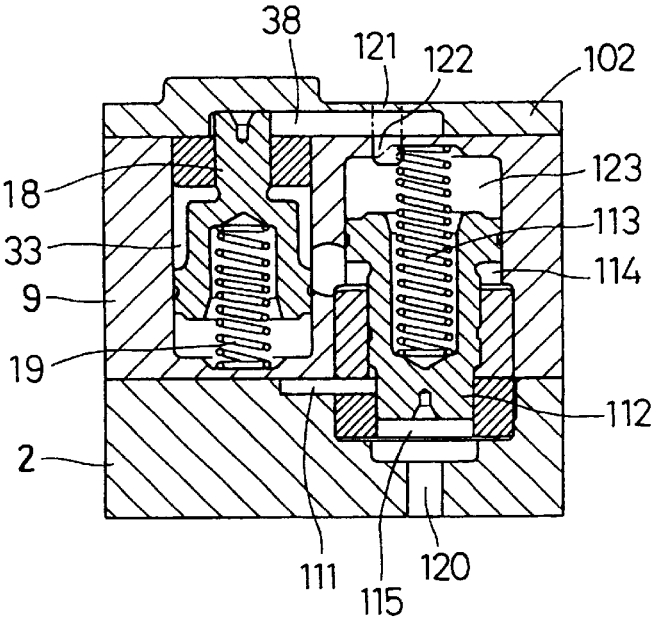
FIG. 42 is a cross sectional view of a VVT in accordance with a twelfth embodiment of the present invention.

FIG. 42 is a cross sectional view of the vicinity of an advance angle restricting pin 112 and a delay angle restricting pin 18. The present embodiment is an example in which an oil discharging port 120 and a pressure releasing port 121 are formed to eliminate the effect of the hydraulic pressure on the motion of the advance angle restricting pin 112. The pins 18, 112 are disposed to have operating direction opposite to the operating direction of the pins 18, 112 of the tenth embodiment. Here, since the basic constitution of the VVT is the same as in the tenth embodiment, the oil discharging port 120 and the pressure releasing port 121 will be described.

The oil discharging port 120 is an passage for discharging the hydraulic oil leaking to an advance angle restricting groove 111 from a hydraulic chamber (a delay angle chamber 7 and an advance angle chamber 8) and is formed in a sprocket 2, as shown in FIG. 42, to open a lock depression 115 made at the end portion of the advance angle restricting groove 111 to the atmosphere.

The pressure releasing port 121 is an passage for discharging the hydraulic oil leaking to the rear end side of the advance angle restricting pin 112 from the control chamber 114 of an advance angle restricting mechanism to the outside of the VVT and is formed in a cover 102 and communicates with a pin receiving depression 123 for receiving the advance angle restricting pin 112 through a communication hole 122 formed in a vane 9. However, the communication hole 122 is formed in the shape of an arc so as to always communicate with the pressure releasing port 121 within the operating range of the rotor 5 (see FIG. 43).

Next, the operation and the effect of the oil discharging port 120 and the pressure releasing port 121 will be described.

For example, when the viscosity of the hydraulic oil becomes lower at high oil temperature, the hydraulic oil easily leaks from the hydraulic chamber, so there is the possibility that the leaking hydraulic oil enters the advance angle restricting groove 111 through the gap between the vane 9 and the sprocket 2.

In contrast, the hydraulic oil leaking to the advance angle restricting groove 111 from the hydraulic chamber can be discharged to the outside of the VVT from the oil discharging port 120, so that it is possible to eliminate the effect of the hydraulic oil on the motion of the advance angle restricting pin 112 when the hydraulic oil pushes out the advance angle restricting pin 112 from the vane 9.

Further, if the hydraulic oil introduced into the control chamber 114 leaks to the rear end side of the advance angle restricting pin 112 when the hydraulic oil pushes back the advance angle restricting pin 112 into the vane 9, the leaked hydraulic oil acts on the advance angle restricting pin 112 in the direction that pushes out the advance angle restricting pin 112 to produce an effect on the motion of the advance angle restricting pin 112 when the hydraulic oil pushes back the advance angle restricting pin 112 into the vane 9. In contrast, the hydraulic oil leaking to the rear end side of the advance angle restricting pin 112 can be discharged to the outside of the VVT from the pressure releasing port 121, so that it is possible to eliminate the effect of the hydraulic oil on the motion of the advance angle restricting pin 112 when the hydraulic oil pushes back the advance angle restricting pin 112 into the vane 9.

Figure 43:
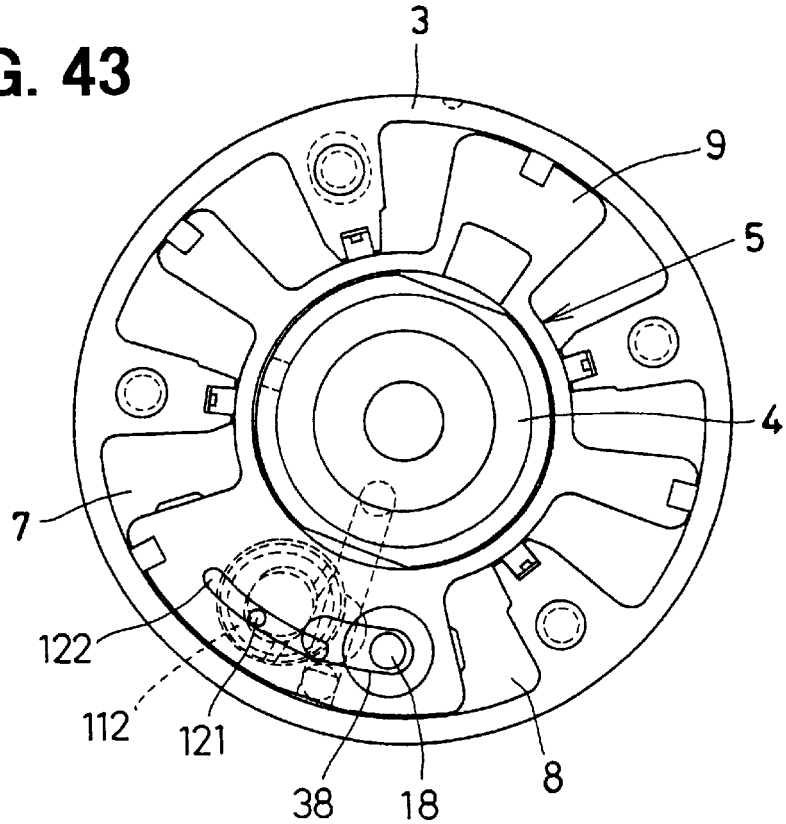
FIG. 43 is a cross sectional view to show a state where a VVT is locked.

Still further, the pressure releasing port 121 of the present embodiment can be also used for eliminating the effect of the hydraulic oil on the motion of the delay angle restricting pin 18. That is, since the advance angle restricting pin 112 and the delay angle restricting pin 18 are incorporated in the common vane 9, as shown in FIG. 43, by making the delay angle restricting groove 38 communicate with the pressure releasing port 121 through the communication port 122 shaped like an arc, it is possible to utilize the pressure releasing port 121 as an oil discharging port for the delay angle restricting pin 18.

However, if the communication hole 122 and the delay angle restricting groove 38 are sealed at the same time by a common vane 9 within the operating range of the rotor 5, the angle of the vane 9 is made very wide to make the operating range of the rotor 5 narrow.

Figure 45:
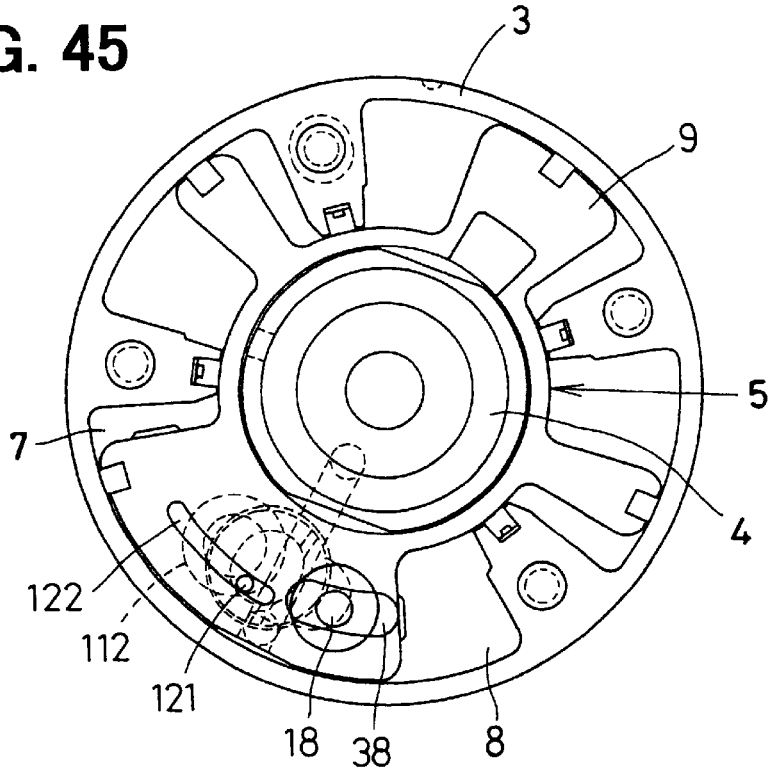
FIG. 45 is a cross sectional view to show a state where a VVT is free.

Therefore, the present embodiment employs the following configuration. The delay angle restricting pin 18 is disposed nearer to the delay angle side than the advance angle restricting pin 112. The advance angle restricting groove 111 is formed at the position where it is sealed by the vane 9 throughout the operating range of the rotor 5. The delay angle restricting groove 38 is formed such that it is sealed from a position of 10° CA before a lock phase (on the advance angle side) by the vane 9. FIG. 45 shows the position of the vane 9 when the vane 9 starts to seal the delay angle restricting groove 38. The delay angle restricting groove 38 and the vane 9 are arranged in such a way that after the delay angle restricting groove 38 is sealed by the vane 9, the delay angle restricting groove 38 communicates with the pressure releasing port 121 through the communication hole 122. This can decrease the angle of the vane 9 and thus secure the increased operating range of the rotor 5 by the same amount.

Figure 44:
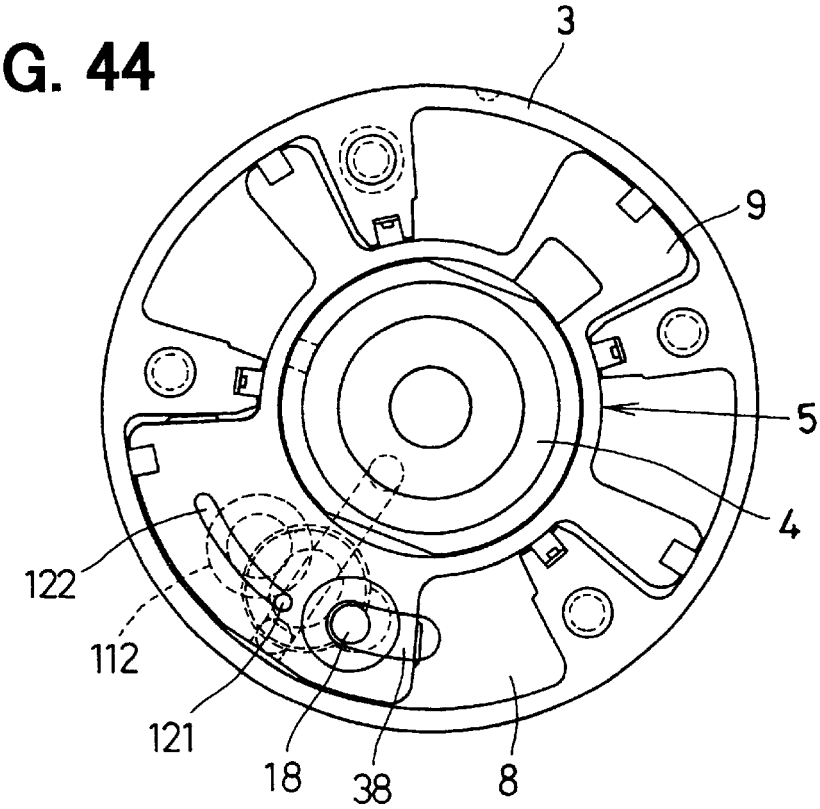
FIG. 44 is a cross sectional view to show a state where a VVT is at the largest advance angle position.

According to the above configuration, for example, when the rotor 5 is at the largest advance angle phase, as shown in FIG. 44, the delay angle restricting groove 38 is not sealed by the vane 9 but a part of the delay angle restricting groove 38 communicates with the advance angle chamber 8. Further, since the delay angle restricting groove 38 does not communicate with the communication hole 122 at this time, the oil in the advance angle chamber 8 does not flow into the communication hole 122 from the delay angle restricting groove 38.

Thereafter, the delay angle restricting groove 38, as shown in FIG. 45, is sealed by the vane 9 at the time when the rotor 5 rotates to the position of 10° CA before the lock phase (on the advance angle side).

Figure 46:
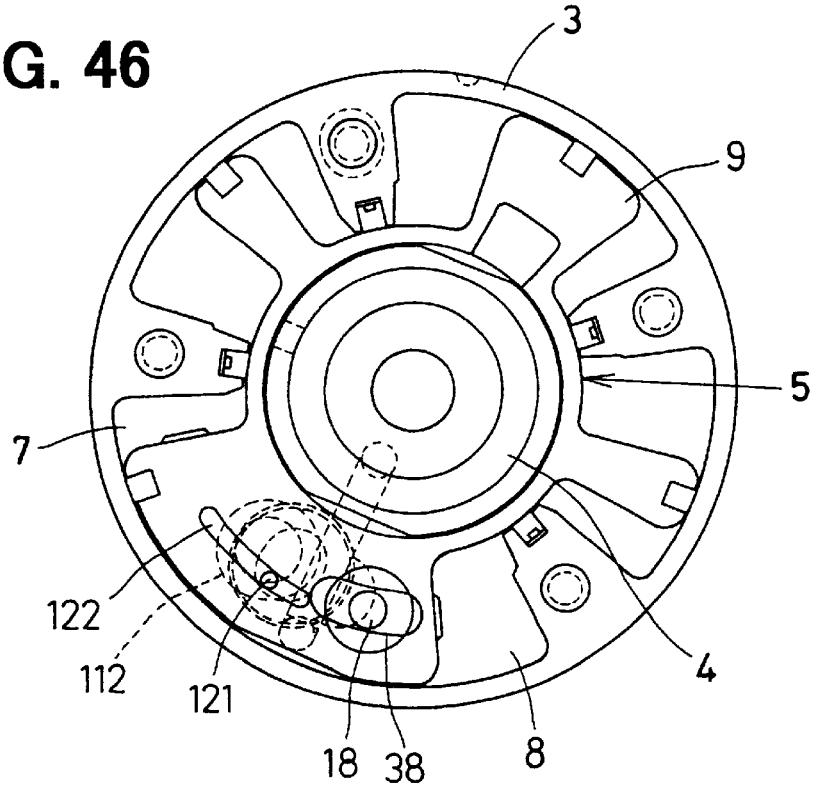
FIG. 46 is a cross sectional view to show a state where a VVT is free.

When the rotor 5 further rotates from the position of 10° CA before the lock phase (on the advance angle side), as shown in FIG. 46, the delay angle restricting groove 38 starts to communicate with the communication hole 122. As a result, since the hydraulic oil leaking to the delay angle restricting groove 38 is discharged to the outside from the pressure releasing hole 121 through the communication hole 122, it is possible to eliminate the effect of the hydraulic pressure on the motion of pushing the delay angle restricting pin 18 when the hydraulic oil pushes out the delay angle restricting pin 18 from the vane 9. In this manner, it is possible to surely fit the tip end of the delay angle restricting pin 18 in the delay angle restricting groove 38 to stop the rotor 5 at the lock phase shown in FIG. 43.

Thirteenth Embodiment

Figure 47:
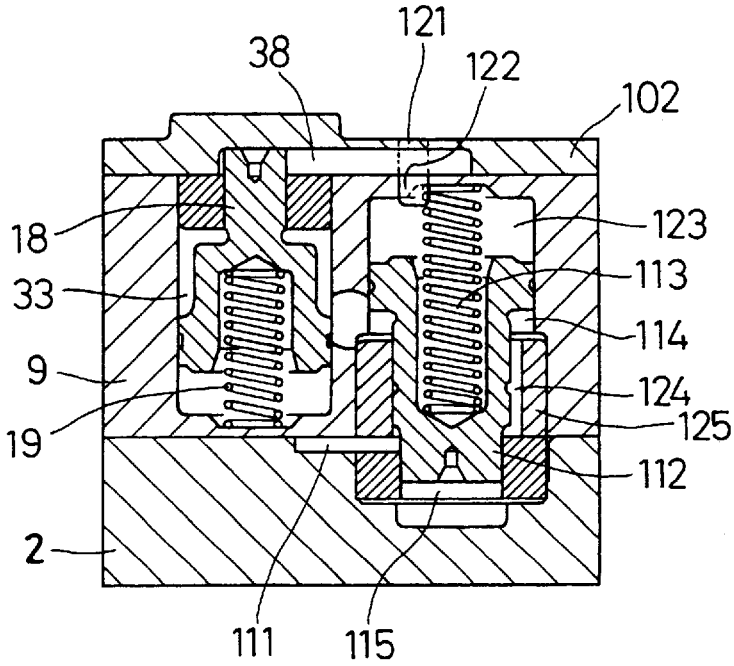
FIG. 47 is a cross sectional view of a VVT in accordance with a thirteenth embodiment of the present invention.
Figure 48:
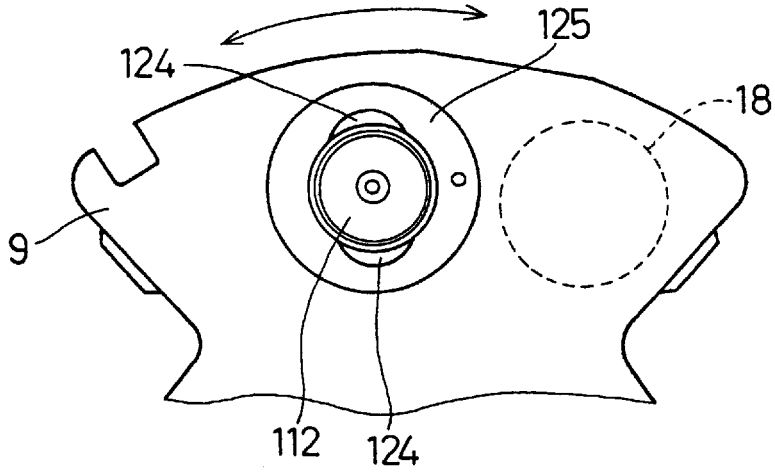
FIG. 48 is a cross sectional view of a vane part of a VVT in accordance with the thirteenth embodiment of the present invention.

FIG. 47 is a cross sectional view of the vicinity of an advance angle restricting pin 112 and a delay angle restricting pin 18, and FIG. 48 is a plan view of the advance angle restricting pin 112 with a sprocket 2 removed when viewed from the tip end side thereof. The present embodiment is an example in which a communication groove 124 for making an advance angle restricting groove 111 communicate with a control chamber 114 is formed in place of the oil discharging port 120 shown in the twelfth embodiment.

As shown in FIG. 47, in a vane 9 is incorporated a cylindrical bearing 125 for slidably locking the advance angle restricting pin 18. The inner circumferential surface of the bearing 125 is depressed to form the communication groove 124. The communication groove 124, as shown in FIG. 48, is formed between the bearing 125 and the advance angle restricting pin 18 in the direction nearly perpendicular to the rotational direction of the rotor 5. Since the hydraulic oil leaking to the advance angle restricting groove 111 from a hydraulic chamber (a delay angle chamber 7 and an advance angle chamber 8) is introduced into the control chamber 114 through the communication groove 124, it is possible to eliminate the effect of the hydraulic pressure on the motion of the advance angle restricting pin 112.

According to the configuration of the present embodiment, since the hydraulic oil leaking to the advance angle restricting groove 111 is introduced into the control chamber 114 through the communication groove 124, it is possible to prevent the hydraulic oil from leaking to the outside.

Further, when the hydraulic oil is introduced into the control chamber 114 to push back the advance angle restricting pin 112 into a vane 9, the hydraulic oil introduced into the control chamber 114 is flowed into the advance angle restricting groove 111 through the communication groove 124 to push down the advance angle restricting pin 112 into the vane 9, so that it is possible to surely push down the advance angle restricting pin 112 even when the hydraulic pressure is low.

At least one oil discharging port may be made for the delay angle restricting pin 18. This oil discharging port can be formed in the same way as the oil discharging ports 120, 121 made for the advance angle restricting pin 112. The oil discharging port may be made for the advance angle restricting pin 112 and the delay angle restricting pin 18. The oil discharging port may be made only for the delay angle restricting pin 18.

Further, the pressure releasing port formed for the delay angle restricting pin 18 may utilize for the advance angle restricting pin 112.

Still further, a communication groove like the communication groove 124 may be formed for the delay angle restricting pin 18.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A variable valve timing apparatus that is interconnected to a drive train for driving a camshaft of an internal combustion engine and varies the rotational phase of the camshaft, the apparatus comprising:

a housing connected to either the drive side or the driven side of the drive train;

a rotor which is connected to the other side of the drive train and is received in the housing so as to rotate relatively to the housing throughout a first angular range;

a hydraulic chamber formed in the housing between the housing and the rotor;

a vane which is received in the hydraulic chamber to partition the hydraulic chamber into an advance angle chamber and a delay angle chamber;

an oil control valve for controlling the supply or discharge of hydraulic oil to or from the advance angle chamber and the delay angle chamber;

a lock pin which has an intermediate phase position set between a largest advance angle position and a largest delay angle position of the rotor with respect to the housing and locks the rotor at the intermediate phase position;

a delay angle restricting pin which is retractably incorporated in the vane and projects its tip end from the vane to interfere with the housing to thereby prevent the rotor from rotating to a delay angle side beyond the intermediate phase position;

a spring for urging the delay angle restricting pin in the direction that pushes out the delay angle restricting pin from the vane;

a control chamber into which the hydraulic oil is introduced through an exclusive oil passage provided independently of an oil passage for introducing the hydraulic oil into the hydraulic chamber to thereby push down the delay angle restricting pin into the vane; and a hydraulic control valve for controlling the hydraulic pressure of the control chamber.

2. A variable valve timing apparatus according to claim 1, wherein the lock pin and the delay angle restricting pin are incorporated in the same vane and are operated in the opposite directions.

3. A variable valve timing apparatus according to claim 1, wherein the exclusive oil passage is provided with an orifice between a hydraulic pump for generating hydraulic pressure and the hydraulic control valve.

4. A variable valve timing apparatus according to claim 1, wherein the delay angle restricting pin has a pressure receiving portion for receiving the hydraulic pressure of the control chamber, the pressure receiving portion being larger in area than the tip end surface of the delay angle restricting pin.

5. A variable valve timing apparatus according to claim 1, wherein the housing is provided with an oil discharging port for discharging the hydraulic oil leaking to the tip end side of the delay angle restricting pin from the hydraulic chamber to the outside.

6. A variable valve timing apparatus according to claim 5, wherein the housing is provided with a delay angle restricting groove in which the delay angle restricting pin can move with its tip end pushed out from the vane when the rotor rotates from before the intermediate phase position to the intermediate phase position, the delay angle restricting groove being opened to the atmosphere via the oil discharging port.

7. A variable valve timing apparatus according to claim 1, wherein the vane is provided with a cylindrical bearing for retractably locking the delay angle restricting pin, a depressed communication groove for making the tip end side of the delay angle restricting pin communicate with the control chamber being formed on its inner circumferential surface.

8. A variable valve timing apparatus according to claim 7, wherein the housing is provided with a delay angle restricting groove in which the delay angle restricting pin can move with its tip end pushed out from the vane when the rotor rotates from before the intermediate phase position to the intermediate phase position, the delay angle restricting groove communicating with the control chamber via the communication groove.

9. A variable valve timing apparatus according to claim 8, wherein the communication groove is formed in the direction nearly perpendicular to the rotational direction of the rotor with respect to the delay angle restricting pin.

10. A variable valve timing apparatus according to claim 1, wherein the housing is provided with a pressure releasing port for discharging the hydraulic oil leaking to the rear end side of the delay angle restricting pin from the control chamber.

11. A variable valve timing apparatus that is interconnected to a drive train for driving a camshaft of an internal combustion engine and varies the rotational phase of the camshaft, the apparatus comprising:

a housing connected to either the drive side or the driven side of the drive train;

a rotor that is connected to the other side of the drive train and is received in the housing so as to rotate relatively to the housing throughout a first angular range;

a hydraulic chamber formed in the housing and between the housing and the rotor;

a vane received in the hydraulic chamber to partition the hydraulic chamber into an advance angle chamber and a delay angle chamber;

a rotor rotation restricting unit in which an intermediate phase position is set between a largest advance angle position and a largest delay angle position of the rotor with respect to the housing and which can prevent the rotor from rotating to at least one of a delay angle side and an advance angle side beyond the intermediate phase position, the rotor rotation restricting unit including;

a restricting pin which is retractably incorporated in the vane and projects its tip end from the vane to interfere with the housing to restrict the rotation of the rotor;

a spring for urging the restricting pin in the direction that pushes out the restricting pin from the vane;

an exclusive oil passage made independently of an oil passage for introducing the hydraulic oil into the hydraulic chamber;

a control chamber into which the hydraulic oil is introduced through the exclusive oil passage to push down the restricting pin into the vane; and a hydraulic control unit for controlling the hydraulic pressure in the control chamber.

12. A variable valve timing apparatus according to claim 11, wherein the rotor rotation restricting unit has at least only one of a delay angle restricting mechanism for preventing the rotor from rotating beyond the intermediate phase position to a delay angle side and an advance angle restricting mechanism for preventing the rotor from rotating beyond the intermediate phase position to an advance angle side.

13. A variable valve timing apparatus according to claim 12, wherein the restricting pin used for either the delay angle restricting mechanism or the advance angle restricting mechanism also serves as a lock pin for locking the rotor at the intermediate phase position.

14. A variable valve timing apparatus according to claim 12, wherein the rotor rotation restricting unit constitutes both mechanisms of the delay angle restricting mechanism and the advance angle restricting mechanism and wherein the respective restricting pins used for both the mechanisms are incorporated in the same vane.

15. A variable valve timing apparatus according to claim 14, wherein the respective restricting pins are operated in the opposite directions in the delay angle restricting mechanism and the advance angle restricting mechanism.

16. A variable valve timing apparatus according to claim 11, wherein the exclusive oil passage is provided with an orifice between a hydraulic pump for generating hydraulic pressure and the hydraulic control unit.

17. A variable valve timing apparatus according to claim 11, wherein the restricting pin has a pressure receiving portion for receiving the hydraulic pressure of the control chamber, the pressure receiving area of the pressure receiving portion being larger than the area of the top surface of the tip end of the restricting pin.

18. A variable valve timing apparatus according to claim 11, wherein the exclusive oil passage communicating with the control chamber is formed in the vane.

19. A variable valve timing apparatus according to claim 11, wherein the hydraulic control unit controls only the hydraulic pressure in the control chamber.

20. A variable valve timing apparatus according to claim 11, wherein the housing is provided with a guide groove in which the restricting pin can move with its tip end projected from the vane when the rotor rotates from before the intermediate phase position to the intermediate phase position and into which the hydraulic oil of the hydraulic chamber does not flow.

21. A variable valve timing apparatus according to claim 11, wherein the housing is provided with an oil discharging port for discharging the hydraulic oil leaking to the tip end side of the restricting pin from the hydraulic chamber to the outside.

22. A variable valve timing apparatus according to claim 21, wherein the housing is provided with a guide groove in which the restricting pin can move with its tip end projected from the vane when the rotor rotates from before the intermediate phase position to the intermediate phase position and which opens to the atmosphere through the oil discharging port.

23. A variable valve timing apparatus according to claim 11, wherein the vane is provided with a cylindrical bearing for retractably supporting the restricting pin, a depressed communication groove for making the tip end side of the restricting pin communicate with the control chamber being formed on its inner circumferential surface.

24. A variable valve timing apparatus according to claim 23, wherein the housing is provided with a guide groove in which the restricting pin can move with its tip end projected from the vane when the rotor rotates from before the intermediate phase position to the intermediate phase position and which communicates with the control chamber through the communication groove.

25. A variable valve timing apparatus according to claim 24, wherein the communication groove is formed in the direction nearly perpendicular to the rotational direction of the rotor with respect to the restricting pin.

26. A variable valve timing apparatus according to claim 11, wherein the housing is provided with an oil discharging port for discharging the hydraulic oil leaking to the rear end side of the restricting pin from the control chamber to the outside.

27. A variable valve timing apparatus according to claim 26, wherein the vane is provided with an arc-shaped communication groove always communicating with the pressure discharging port within the operating range of the rotor.

28. A variable valve timing apparatus according to claim 11, wherein the restricting pin includes a delay angle restricting pin for preventing the rotor from rotating from the intermediate phase position to a delay angle side and an advance angle restricting pin for preventing the rotor from rotating from the intermediate phase position to an advance angle side, and wherein the housing is provided with a pressure releasing port for discharging the hydraulic oil leaking to the rear end side of the advance angle restricting pin from the control chamber to the outside to thereby discharge the hydraulic oil leaking to the tip end side of the delay angle restricting pin from the hydraulic chamber when the delay angle restricting pin is operated to the outside through the pressure releasing port.

29. A variable valve timing apparatus according to claim 28, wherein the housing is provided with a delay angle restricting groove in which the delay angle restricting pin can move with its tip end projected from the vane during a delay angle control for rotating the rotor from an advance angle side to the intermediate phase position, wherein the vane is provided with an arc-shaped communication hole always communicating with the pressure releasing port within the operating range of the rotor, and wherein when the rotor is operated under a delay angle control, the delay angle restricting groove is sealed by the vane and then the pressure releasing port communicates with the delay angle restricting groove through the communication hole.

30. A variable valve timing apparatus according to claim 11, wherein the restricting pin includes a delay angle restricting pin for preventing the rotor from rotating from the intermediate phase position to a delay angle side and an advance angle restricting pin for preventing the rotor from rotating from the intermediate phase position to an advance angle side, and wherein the housing is provided with a pressure releasing port for discharging the hydraulic oil leaking to the rear end side of the delay angle restricting pin from the control chamber to the outside, and wherein the hydraulic oil leaking to the tip end side of the advance angle restricting pin from the hydraulic chamber when the advance angle restricting pin is operated is discharged to the outside through the pressure releasing port.

31. A variable valve timing apparatus according to claim 30, wherein the housing is provided with an advance angle restricting groove in which the advance angle restricting pin can move with its tip end projected from the vane during an advance angle control for rotating the rotor from a delay angle side to the intermediate phase position, wherein the vane is provided with an arc-shaped communication hole always communicating with the pressure releasing port within the operating range of the rotor, and wherein when the rotor is operated under the advance angle control, the advance angle restricting groove is sealed by the vane and then the pressure releasing port communicates with the advance angle restricting groove through the communication hole.

* * * * *

UNITED STATES PATENT AND TRADEMARK OFFICE

CERTIFICATE OF CORRECTION

PATENT NO. : 6,779,499 B2
DATED : August 24, 2004
INVENTOR(S) : Takenaka

It is certified that error appears in the above-identified patent and that said Letters Patent is hereby corrected as shown below:

Title page,
Item [75], Inventor should read -- Akihiko Takenaka, Anjo (JP) --

Signed and Sealed this

Fifteenth Day of March, 2005

JON W. DUDAS
*Director of the United States Patent and Trademark Office*